US007618313B2

(12) United States Patent
Ghaly

(10) Patent No.: US 7,618,313 B2
(45) Date of Patent: Nov. 17, 2009

(54) ELECTRONIC WORD PUZZLE

(76) Inventor: Nabil N. Ghaly, 14 Longwood Dr., South Huntington, NY (US) 11746

( * ) Notice: Subject to any disclaimer, the term of this patent is extended or adjusted under 35 U.S.C. 154(b) by 321 days.

(21) Appl. No.: 10/854,481

(22) Filed: May 27, 2004

(65) Prior Publication Data

US 2004/0242295 A1 Dec. 2, 2004

Related U.S. Application Data

(60) Provisional application No. 60/473,707, filed on May 29, 2003.

(51) Int. Cl.
*A63F 9/24* (2006.01)
*A63F 13/00* (2006.01)

(52) U.S. Cl. ..... 463/9; 463/37; 434/272

(58) Field of Classification Search ..... 463/9, 463/10, 19, 46; 273/272, 299, 153 R, 236, 273/237, 273, 281, 288, 289, 292, 460; 434/118, 434/128, 322
See application file for complete search history.

(56) References Cited

U.S. PATENT DOCUMENTS 4,863,172 A * 9/1989 Rosenwinkel et al. .... 273/153 S
5,423,556 A * 6/1995 Latypov ..... 463/9
5,573,245 A * 11/1996 Weiner et al. ..... 273/153 R
5,921,864 A * 7/1999 Walker et al. ..... 463/9
6,206,372 B1 * 3/2001 Harris ..... 273/153 S
6,308,954 B1 * 10/2001 Breeler ..... 273/153 R
6,364,766 B1 * 4/2002 Anderson et al. ..... 463/16
6,568,683 B1 * 5/2003 Harpaz ..... 273/460
6,685,561 B2 * 2/2004 Anderson et al. ..... 463/16
7,112,135 B2 * 9/2006 Anderson et al. ..... 463/16
2002/0037764 A1 * 3/2002 Anderson et al. ..... 463/16
2003/0060250 A1 * 3/2003 Chan ..... 463/9
2003/0224842 A1 * 12/2003 Kogod et al. ..... 463/1
2004/0142738 A1 * 7/2004 Anderson et al. ..... 463/16
2006/0252487 A1 * 11/2006 Anderson et al. ..... 463/16
2006/0252492 A1 * 11/2006 Anderson et al. ..... 463/17

FOREIGN PATENT DOCUMENTS

WO WO 0240119 A1 * 5/2002

OTHER PUBLICATIONS

"Jumble Electronic Word Game" Instruction Manual for Model 07-010 Copyright 1998 Tiger Electronics Inc.*
"Word Search Creator", sourced from http://www.afreego.com/Categories/Games/Word/011712.php, by Inverted Matrix, Inc., Release Date Jan. 01, 2003.*

* cited by examiner

*Primary Examiner*—John M Hotaling, II
*Assistant Examiner*—Steven J. Hylinski

(57) ABSTRACT

A word puzzle device, method and apparatus, is disclosed which is based on the popular "find a word," and "form a word" games. The puzzle employs logical structures to scramble an initial board display of characters, and requires a player to reconstruct the scrambled board before finding predefined words hidden in the display. The logical structures include a shift process, and a cause/effect process to change the position of characters in the display, or to replace characters with other characters based on predefined rules. When playing "form a word" game, a player is permitted to shift rows and/or columns, and/or activate control points to replace characters, to form as many new words as possibly can within a predetermined period of time. The puzzle device includes means to store a plurality of games, and input control mechanisms to enable a player to interact with the device. The device keeps a score that measures the player's skills in solving the word puzzle.

30 Claims, 38 Drawing Sheets

| Initial Letter | First Activation | Second Activation |
|---|---|---|
| A | B | A |
| B | C | B |
| C | D | C |
| D | E | D |
| E | F | E |
| F | G | F |
| G | H | G |
| H | I | H |
| I | J | I |
| J | K | J |
| K | L | K |
| L | M | L |
| M | N | M |
| N | O | N |
| O | P | O |
| P | Q | P |
| Q | R | Q |
| R | S | R |
| S | T | S |
| T | U | T |
| U | V | U |
| V | W | V |
| W | X | W |
| X | Y | X |
| Y | Z | Y |
| Z | A | Z |

Figure – 3 -

| Initial Letter | First Activation | Second Activation | Third Activation |
|---|---|---|---|
| A | B | C | A |
| B | C | D | B |
| C | D | E | C |
| D | E | F | D |
| E | F | G | E |
| F | G | H | F |
| G | H | I | G |
| H | I | J | H |
| I | J | K | I |
| J | K | L | J |
| K | L | M | K |
| L | M | N | L |
| M | N | O | M |
| N | O | P | N |
| O | P | Q | O |
| P | Q | R | P |
| Q | R | S | Q |
| R | S | T | R |
| S | T | U | S |
| T | U | V | T |
| U | V | W | U |
| V | W | X | V |
| W | X | Y | W |
| X | Y | Z | X |
| Y | Z | A | Y |
| Z | A | B | Z |

Figure -4-

LETTER SUBSTITUTION – 4 STATES PER POSITION

| Initial Letter | First Activation | Second Activation | Third Activation | Fourth Activation |
|---|---|---|---|---|
| A | B | C | D | A |
| B | C | D | E | B |
| C | D | E | F | C |
| D | E | F | G | D |
| E | F | G | H | E |
| F | G | H | I | F |
| G | H | I | J | G |
| H | I | J | K | H |
| I | J | K | L | I |
| J | K | L | M | J |
| K | L | M | N | K |
| L | M | N | O | L |
| M | N | O | P | M |
| N | O | P | Q | N |
| O | P | Q | R | O |
| P | Q | R | S | P |
| Q | R | S | T | Q |
| R | S | T | U | R |
| S | T | U | V | S |
| T | U | V | W | T |
| U | V | W | X | U |
| V | W | X | Y | V |
| W | X | Y | Z | W |
| X | Y | Z | A | X |
| Y | Z | A | B | Y |
| Z | A | B | C | Z |

Figure – 5 -

ELECTRONIC WORD PUZZLE

This utility application benefits from provisional application of U.S. Ser. No. 60/473,707, filed on May 29, 2003

BACKGROUND OF THE INVENTION

1. Field of the Invention

Word games represent an important sector of games and puzzles, and have been around for many years. Crossword puzzles and Scrabble are examples of popular word games. The popularity of such puzzles is based, in part, on the challenge they present to a player. Further, word puzzles are a fun way to enhance a player's language skills. Most word games are presented to players either on paper, or in the form of a board game using letters as playing pieces. Recently, few word games have been implemented using electronic devices that are programmed to provide the functionality of a known word puzzle, or to provide new word games.

However, to the inventor's knowledge, none of the electronic word games has taken advantage of the computational capability and versatility of microprocessor based devices. Recent innovation in microelectronics makes it feasible to construct more challenging, versatile and cost effective word games, using commercially available micro-controllers or microprocessors.

For the foregoing reasons, there is a need for improved word puzzles that combine traditional word games with logical steps that would make such word games more interesting and challenging to players. Accordingly, this invention provides an electronic board game, or hand held word game, based in part on the popular "form-a-word," "find-a-word" and/or "circle-a-word" games, and incorporating a novel logical methodology for making these games more intriguing.

2. Description of the Related Art

Classical word games such as "Find a Word," and "Form a Word" are well known in the art, and can be played using pencil and paper, or as a board game with alphabet playing pieces as described in U.S. Pat. Nos. 4,252,323, 5,100,150 & 5,520,394, and as also used in Scrabble. U.S. Pat. No. 4,438,932 describes an electronic word game that employs a pictorial illustration of the anatomy of a person on gallows to help a player discover the spelling letters for a word selected by another player. Other electronic word games are described in U.S. Pat. Nos. 5,921,864, and 6,116,604.

OBJECT OF THE INVENTION

This invention relates to an electronic word game method and apparatus that is based, in part, on popular games such as "form-a-word," "find-a-word" or "circle-a word." The game can be implemented in a board game format for a plurality of players, or as a handheld electronic game for use by a single player. One object of the game is for a player to find words hidden in a field of play presented to a player on an LCD or a CRT screen, or to form words by combining letters on a certain playing axis. The field of play consists of a plurality of playing positions defined by the intersection of two or more axes on the surface of the playing field. Examples of such axes are vertical, horizontal or a diagonal axis on a flat surface. Each playing position displays a character of the alphabet that may be combined with adjacent letters or characters to form words. In one game variation, hidden game words are placed along a horizontal, vertical or diagonal axis on the field of play, then an entire column or row of letters is shifted along the horizontal or vertical axis such that one or more game words is further hidden by replacing one of its characters with another character from adjacent playing positions. This shifting process may be repeated a number of times in order to obtain an initial display for a word puzzle. Alternatively, words may be further hidden by replacing certain characters with other characters using a cause/effect logical function. Accordingly, it is one object of this invention to provide a new word game device whereon a player attempt to find hidden words by first shifting appropriate row(s) and/or column(s) in order to align all the letters forming a hidden word on the same axis.

It is another object of this invention to provide a word game device whereon a player attempts to form as many words as possible by shifting appropriate row(s) and/or columns(s), until an optimum relative position between columns and rows is reached. Such optimum position would result in a maximum number of recognized words.

It is also an object of this invention to provide a new word game device whereon a player attempts to find hidden words by first activating one or more control points in order to replace certain letters with other letters that belong to hidden words.

It is yet another object of the current invention to provide a word game that is implemented using a hand held electronic device, which includes an LCD screen in order to present a game to a player.

It is still an object of this invention to provide a word game that is implemented on a three dimensional housing, such as a sphere or a cube, and whereon a plurality of LCD screens are mounted on the surface of said three dimensional housing to present a game to a player.

It is also an object of this invention to provide a word game that can be implemented on a hand held computing device such as a palm pilot, electronic organizer or the like.

It is still another object of the current invention to provide a word game that can be played on a personal computer system, or on the Internet.

It is yet another object of this invention to provide a word game device that includes a mechanism to change the level of difficulty of game play, or to provide more or less difficult games.

It is also an object of this invention to provide an electronic game device that includes a mechanism for generating a plurality of games, or for selecting a game from a plurality of games stored in the memory of the device.

It is still an object of this invention to provide an electronic word game device that includes a removable cartridge for storing additional games.

It is further an object of this invention to provide a board word game that can be played by a plurality of players.

It is also an object of the current invention to provide a new word game that challenges a player or players to solve the game within a predetermined period of time, or a predetermined number of steps.

It is also an object of this invention to provide a board word game that can be played by a plurality of players, and which is based on pre-defined set of rules.

It is still an object of this invention to provide word game device that incorporates visual and/or audible effects to heighten the enjoyment of the game.

It is another object of the invention to achieve the above objectives in an economical and easy to implement fashion.

BRIEF SUMMARY OF THE INVENTION

The foregoing and other objects of the invention are achieved in accordance with a preferred embodiment of the invention by providing a hand held device comprising a housing, a plurality of input control mechanisms to enable a player to interact with the device, a microprocessor or micro-controller to control the operation of the device, computer memory to store a plurality of games, as well as to store interim data produced during the course of a game, an indicator such as a liquid crystal display, a light emitting diode display, a cathode ray tube display, or the like to present a word game to the player, and a control logic executed on the processor to provide the functionality of the word game. The indicator is subdivided into a plurality display positions configured as columns and rows, and each of these display positions indicates one character of the alphabet. The indicator should preferably consist of a square display surface, with equal number of columns and rows, to provide three playing axes along which words are placed or formed. In the preferred embodiment, words are placed or formed along the vertical, horizontal or diagonal axis.

In one game variation, a word game that consist of letters placed at all display positions is presented to the player with the objective of finding one or more predetermined hidden words. First, an initial configuration of letters is formed, and includes predetermined words placed along the various axes of the playing field. Then said initial configuration is manipulated to produce an initial display that is presented to the player. The manipulation of the initial configuration consists of the processing of certain logical steps that would scramble letters included in the hidden words, as well as other letters contained in the initial configuration, in order to further hide the words from the player. The preferred embodiment provides two alternate logical structures to manipulate the initial configuration. The first logical structure consists of shifting an entire row or column of letters along the horizontal or vertical axis in order to partially scramble the predetermined words. The process of shifting columns and/or rows may be repeated to increase the difficulty of game play. Further, the shifting of a row or column is defined as shifting an entire row or column by one position in either of the two directions defining a particular axis. During a shift process, the letters located at the perimeter of the display field are wrapped around the display field. For example, when shifting a row to the right, along a horizontal axis, the letter located at the right edge of the playfield will be wrapped around to the left edge of the playfield. Similarly, when shifting a column up, along a vertical axis, a letter located at the top edge of the playfield will be wrapped around to the bottom edge of the playfield. A row or column may be shifted more than once during the process of forming a game board.

The second logical structure is based on the identification of a plurality of control points on the playfield, as well as the identification of associated sets of cause/effect relationships. A cause/effect relationship is a geometrical association between a control point and one or more display locations. A control point is located at a display location, and is activated by an entry control mechanism such as touch screen controls. Upon the activation of a control point, the letters at the associated display locations will be replaced with other letters of the alphabet based on predetermined rules. Linked to each display location is a plurality of logical states, each of which defines a replacement letter for the original letter of the initial configuration. Further each of these logical states is reached by successive activations of an associated control point. The number of logical states per display location is a design choice. For example, in a game that provides two logical states per display location, and where the replacement of letters is based on a simple rule of substituting a letter with a consecutive letter from the alphabet set, and if the initial letter is "J," then upon the activation of an associated control point, the letter "J" will be replaced by the letter "K." A second activation of said control point would replace the letter "K" with the original letter "J." Similarly, in a game that provides three logical states per display position, and using the same replacement rule of the first example, and if the initial letter is "C," then upon the first activation of the associated control point, the letter "C" is replaced with the letter "D." Upon the second activation of said control point, the letter "D" is replaced with the letter "E," and upon the third activation of the control point, the letter "E" is replaced with the original letter "C." Accordingly, the initial configuration is manipulated by a sequence of activations of control points in order to produce an initial display that would present a word puzzle to a player.

Upon the formation of an initial display, the player is challenged to find the predetermined hidden words. In order to solve the puzzle, the player must reconstruct a display that reflects the initial configuration of letters, and positively identify all the hidden words. To reconstruct said initial configuration, the player must manipulate the initial display by either shifting appropriate rows and/or columns to align the hidden words along the various axes, or by activating the appropriate control points in order to restore the original letters belonging to the hidden words, depending on the logical steps used to form the initial display.

In order to make a game more interesting and challenging, words similar, or identical, to hidden words may be formed during the transition from the initial display to the display that reflects the initial configuration. A word is similar to a hidden word if it contains two or more letters from the hidden word in the same relative positions. Further, upon a positive identification of a hidden word by the player, such word is highlighted and all control functions affecting said word are disabled. For example, in a game that employs the shift process, if a player positively identifies a hidden word comprised of five letters and placed along a vertical axis, then the five rows corresponding to the five letters would be frozen in their current relative positions. Similarly, identifying a word placed along a horizontal axis would freeze the corresponding columns. Further, identifying a word placed along a diagonal axis would freeze both columns and rows corresponding to the word. Alternatively, in a game that employs cause/effect process, all control points affecting any letter of the identified word would be disabled. Accordingly, a premature identification of a hidden word, or an identification of a "fake" word may result in a failure by the player to solve the game. A "fake" word is identical to a hidden word, and is provided in a transition display as a decoy in order to make a game more challenging.

In another game variation, a player is presented with an initial configuration of letters with the objective of forming as many words as possible within a predetermined period of time. The player may manipulate the initial configuration of letters to form new words using either the shift process or the cause/effect process depending on the logical technique provided for the game. Upon the formation and identification of a new word, the device would accumulate a score for the player based on predetermined rules for calculation of scores. The player is allowed to continue to manipulate the display even if such manipulation would result in the scrambling of words that were previously formed by the player. However, the player will not receive additional credit if the same word is formed twice.

The same objects of the invention can also be achieved in accordance with an alternate embodiment of the invention by providing a board game for a plurality of players. The board game is based on the same concepts employed by the preferred embodiment, and consists of an electronic board having a field of play subdivided into a plurality of playing positions. An indicator located on the field of play provides a plurality of display locations, each of which corresponds to a playing position, and indicates one letter of the alphabet to form words along a plurality of axes on the play field. Each player is provided with a plurality of input control mechanisms to enable the player to interact with the board game. The electronic board includes a housing that contains a micro-controller or a microprocessor to control the operation of the device, computer memory to store a plurality of games, as well as to store interim data produced during the course of a game, an indicator implemented using a liquid crystal display, a light emitting diode display, a mechanical display, or the like to present a word game to the player, and a control logic executed on the processor to provide the functionality of the word game.

Players take turn to interact with the electronic board word game with the objective of forming words or finding hidden words. Game rules are provided to regulate when a player takes turn, how to keep scores for the game, and when a game is over. Similar to the hand held game, the board is manipulated by a logical process to scramble words and make a game more interesting and challenging. Two logical processes are provided. The first is based on shifting rows and/or columns, and the second is based on activating control points associated with playing positions. Players can select between various difficulty levels of play, as well as between a variety of games provided.

BRIEF DESCRIPTION OF THE DRAWINGS

The foregoing summary, as well as the following detailed descriptions of the preferred and alternate embodiments of the invention, will be better understood when in conjunction with the appended drawings, it being understood, however, that this invention is not limited to the precise arrangements illustrated in the drawings.

FIG. 3 is a tabulation of letter substitution for a game that employs two logical states for each display position.

FIG. 4 is a tabulation of letter substitution for a game that employs three logical states for each display position.

FIG. 5 is a tabulation of letter substitution for a game that employs four logical states for each display position.

DETAILED DESCRIPTION OF A PREFERRED EMBODIMENT

Figure 1:
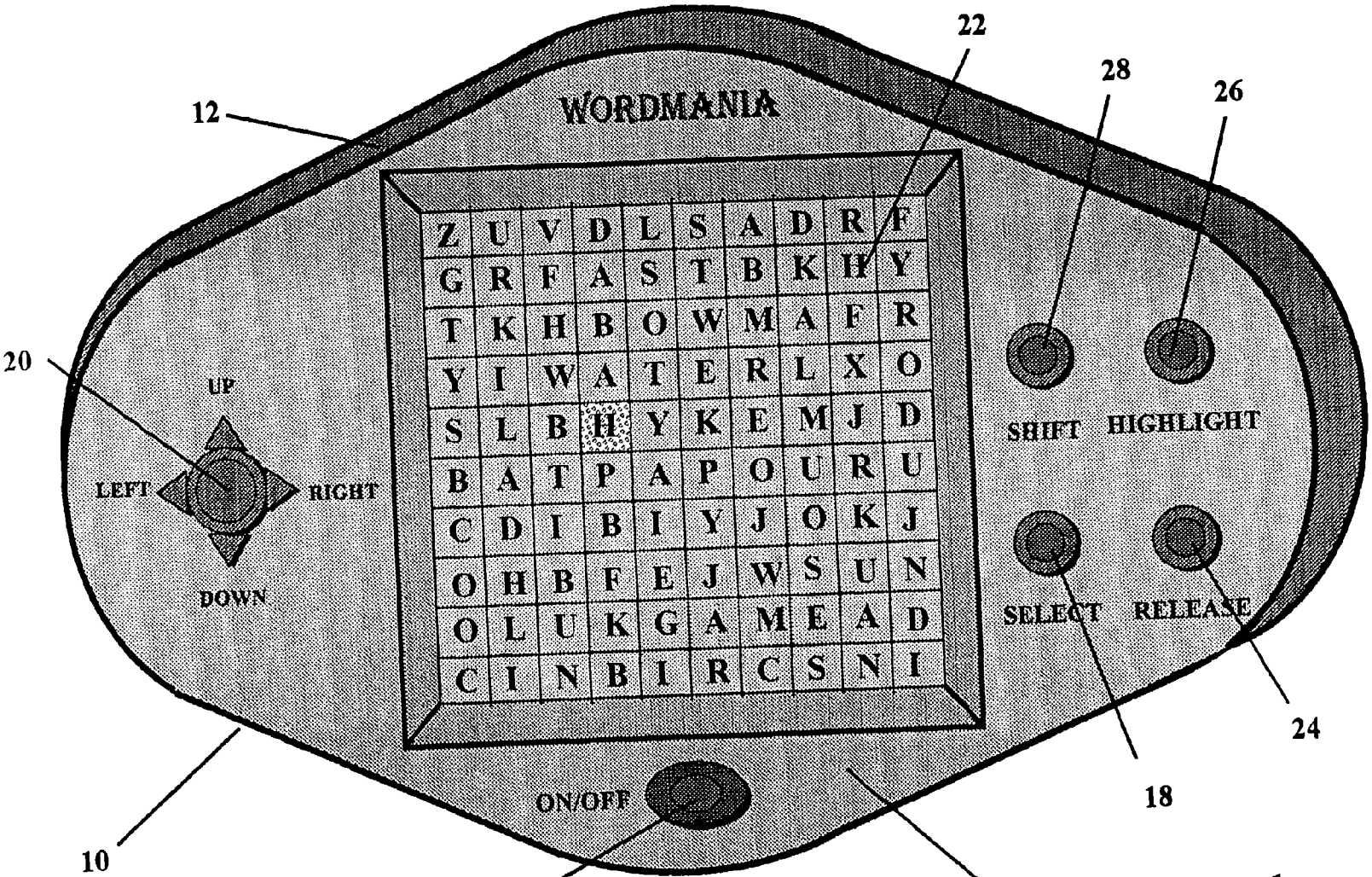
FIG. 1 is a perspective view of the preferred embodiment of a hand-held device according to the invention.
Figure 2:
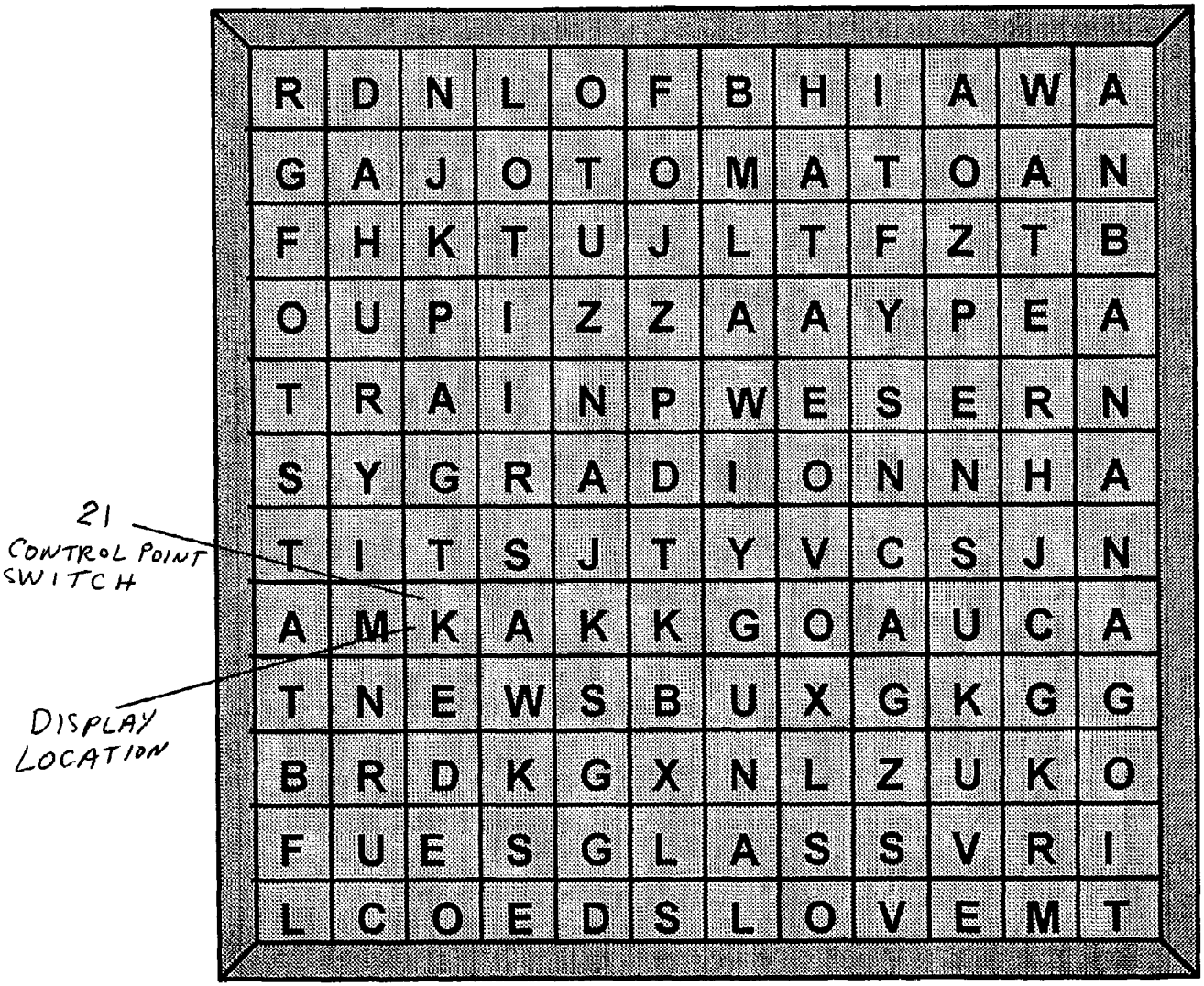
FIG. 2 is display showing 144 playing positions.

Referring now to the drawings where the illustrations are for the purpose of describing the preferred embodiment of the invention and are not intended to limit the invention hereto. FIG. 1 is a perspective view of an electronic hand-held game device 10 comprised of a housing 12 having a face 14 and carrying a liquid crystal display (LCD) screen 22, which provides a field of play that consists of an array of combined display positions and control points. In a specific embodiment illustrated in FIG. 2, an array of twelve (12) rows and twelve (12) columns defines a field of play having one hundred and forty-four (144) playing positions, each of which consists of a control point switch 21 and a display location. The playing positions are referred to as 22-(1, 1) through 22-(12, 12). A specific playing position is referred to as 22-(i, j), where "i" designates the row, and "j" designates the column corresponding to the playing position. Each playing position is used to display one character of an alphabet. It should be noted that the number of playing positions provided is a design parameter selected by a game designer based on the size of the display area, and the desired font size. As would be obvious to a person of ordinary skill in the art, the number of playing positions can be increased or decreased by modifying the software program used to control the device. Further, the field of play is not limited to a square field where the number of rows and columns are equal. A rectangular field of play may be used.

The device shown in FIG. 1, also, includes an on/off switch 16, which controls the operational state of the device, and the connection of the internal battery supply 82 to the electronic circuitry, a multi-function, two-dimensional curser switch 20, which enables a player to place the curser at any playing position, row or column by manipulating the up, right, down, or left control functions of the curser switch, a select push button 18 that permits a player to activate a control point associated with a playing position, or to select a highlighted string of characters, a highlight function button 26 to enable a player to highlight a string of characters, a release function button 24 to release a word, and a shift function button 28 to enable a player to shift an entire row or a column in a desired direction. The shift function button is used by the player in conjunction with the curser control button 20. To shift an entire column up, the player must first place the curser at any location on the desired column. The player must then simultaneously depress the "up" control function of the curser switch and the shift push button. Similarly, to shift an entire row to the right, the player must first place the curser at any location on the desired row. The player must then simultaneously depress the "right" control function of the curser switch and the shift push button. The device also includes a loudspeaker 76, which is positioned in the middle portion of the back cover of the housing, and perforations 74 are provided to permit sounds from the loudspeaker 76 to issue from the housing.

Figure 6:
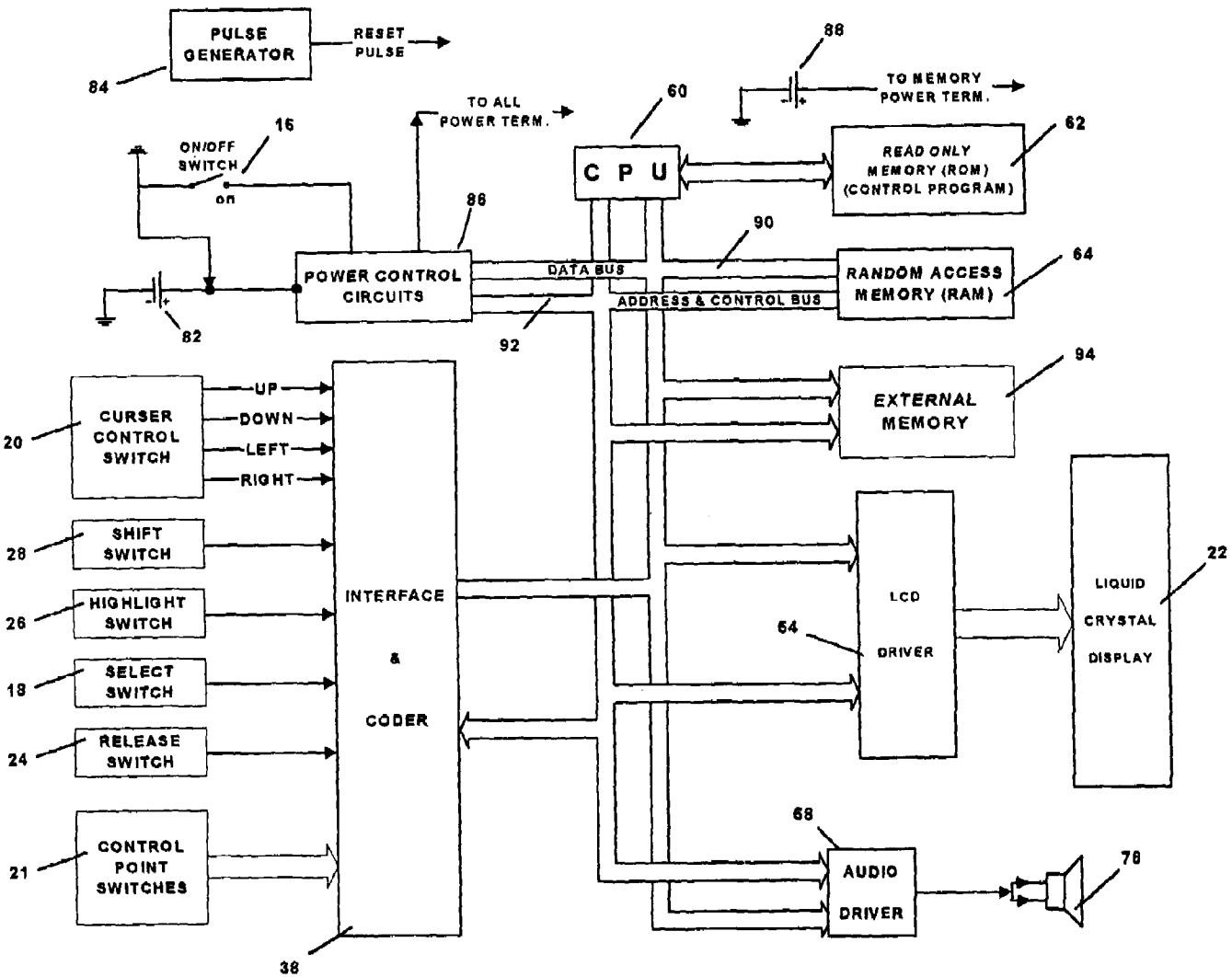
FIG. 6 is a block diagram of the control circuits utilized by the preferred embodiment in accordance with the current invention.
Figure 7:
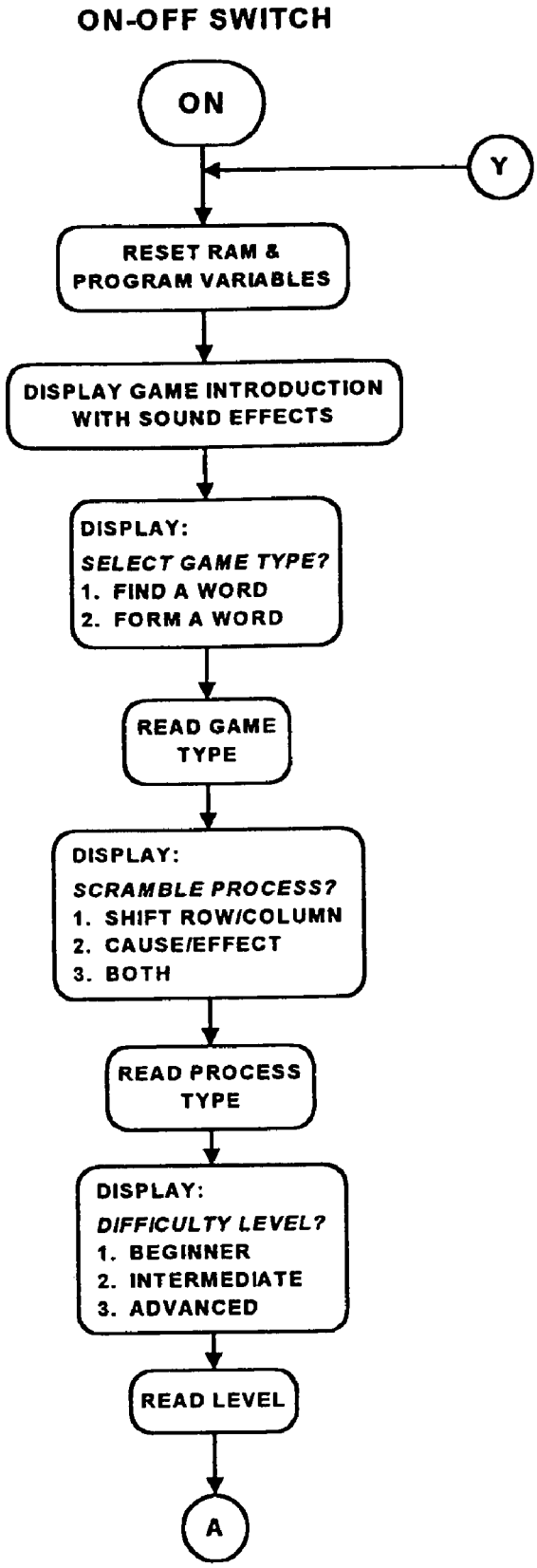
FIGS. 7-20 is a logical flow diagram illustrating the main program functions performed by the microprocessor controlling the device according to the invention.
Figure 8:
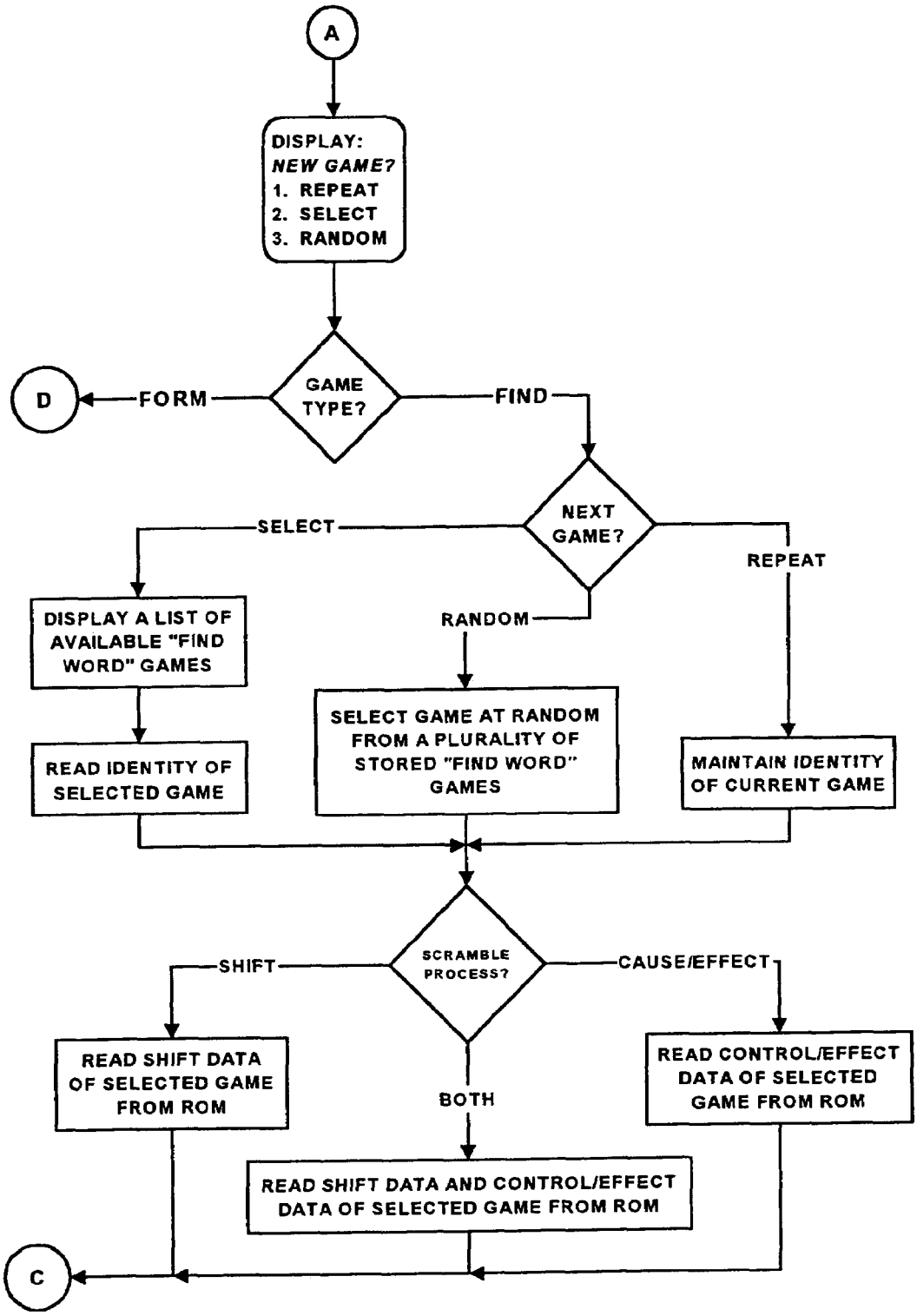
Figure 9:
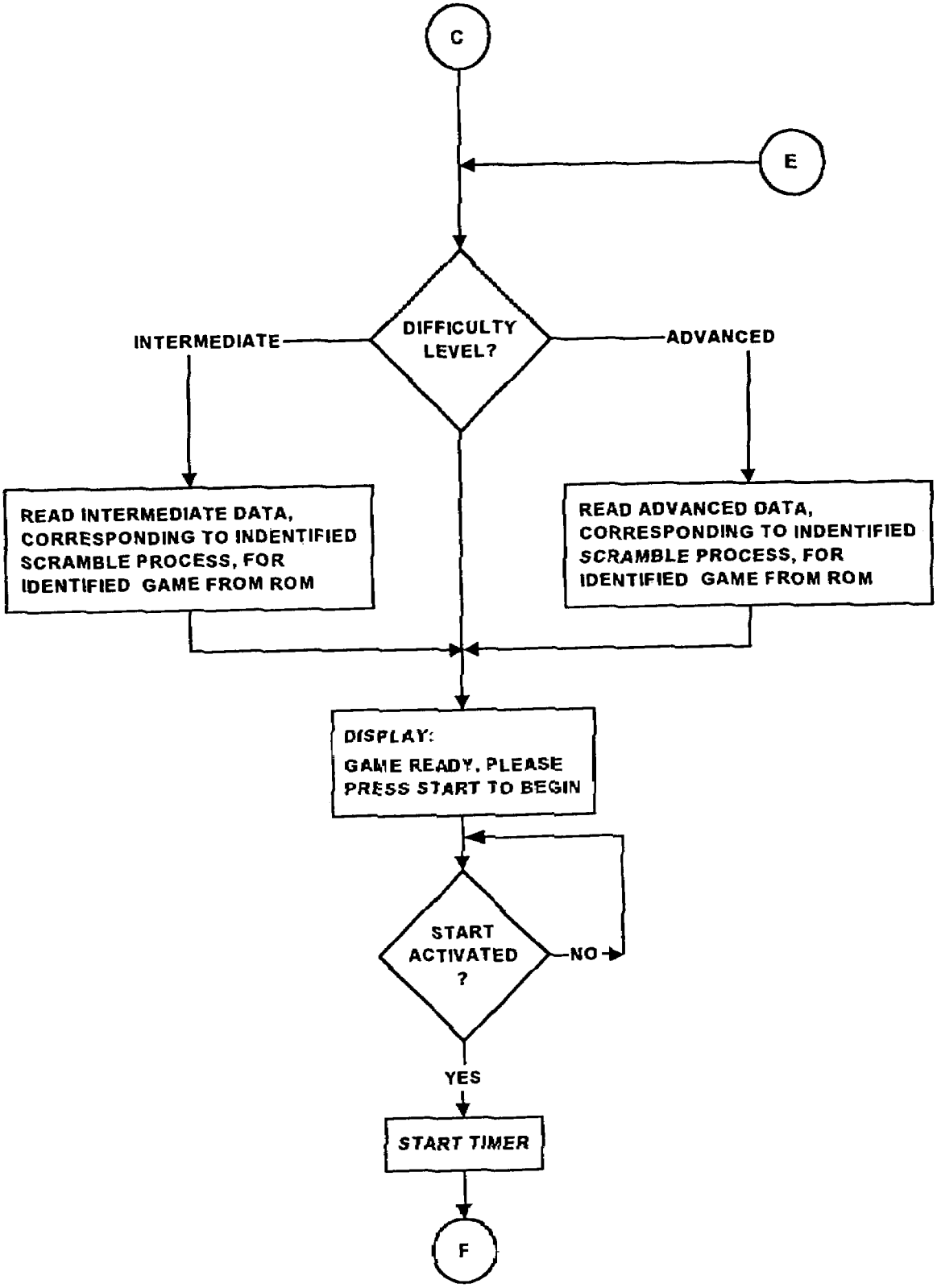
Figure 10:
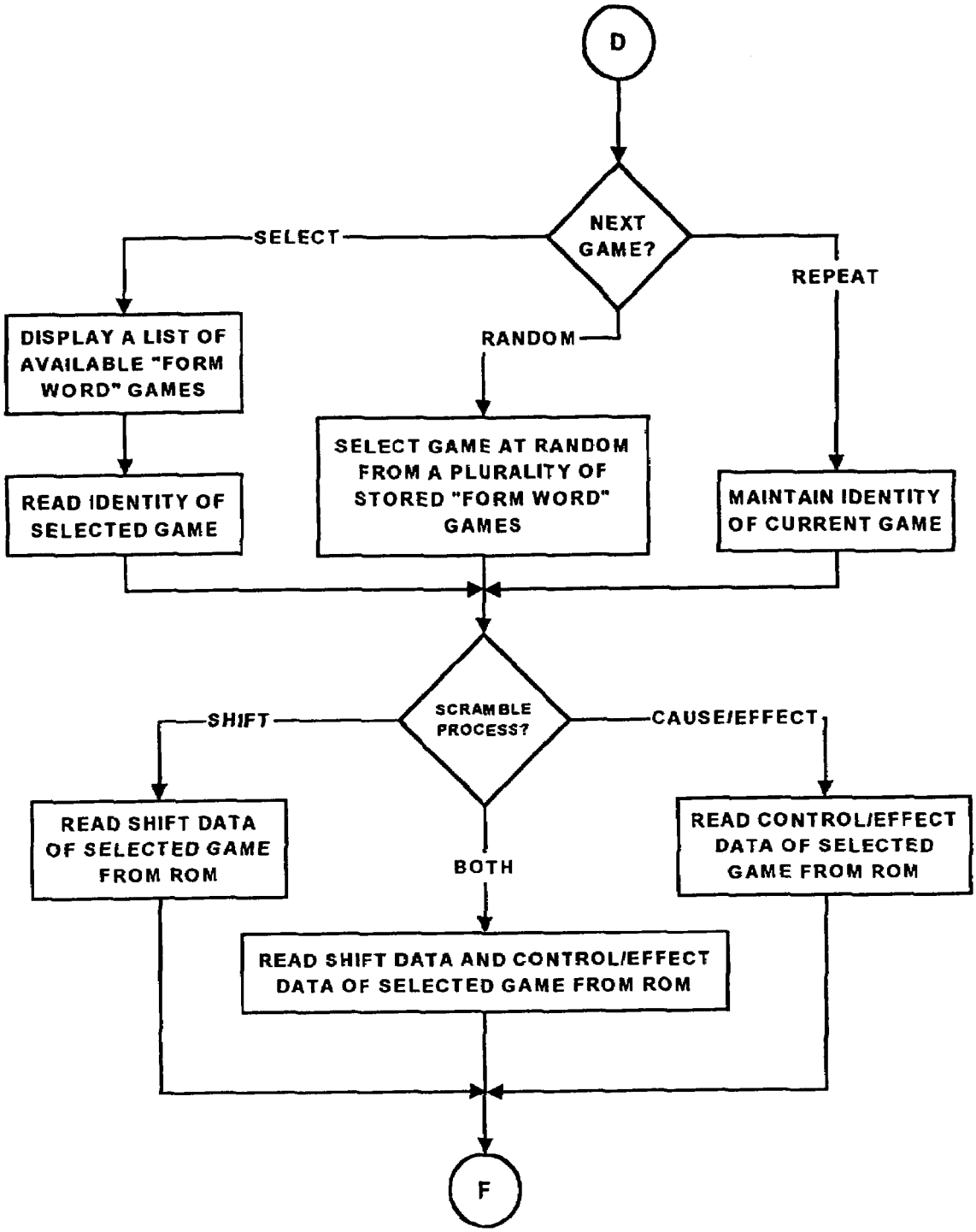
Figure 11:
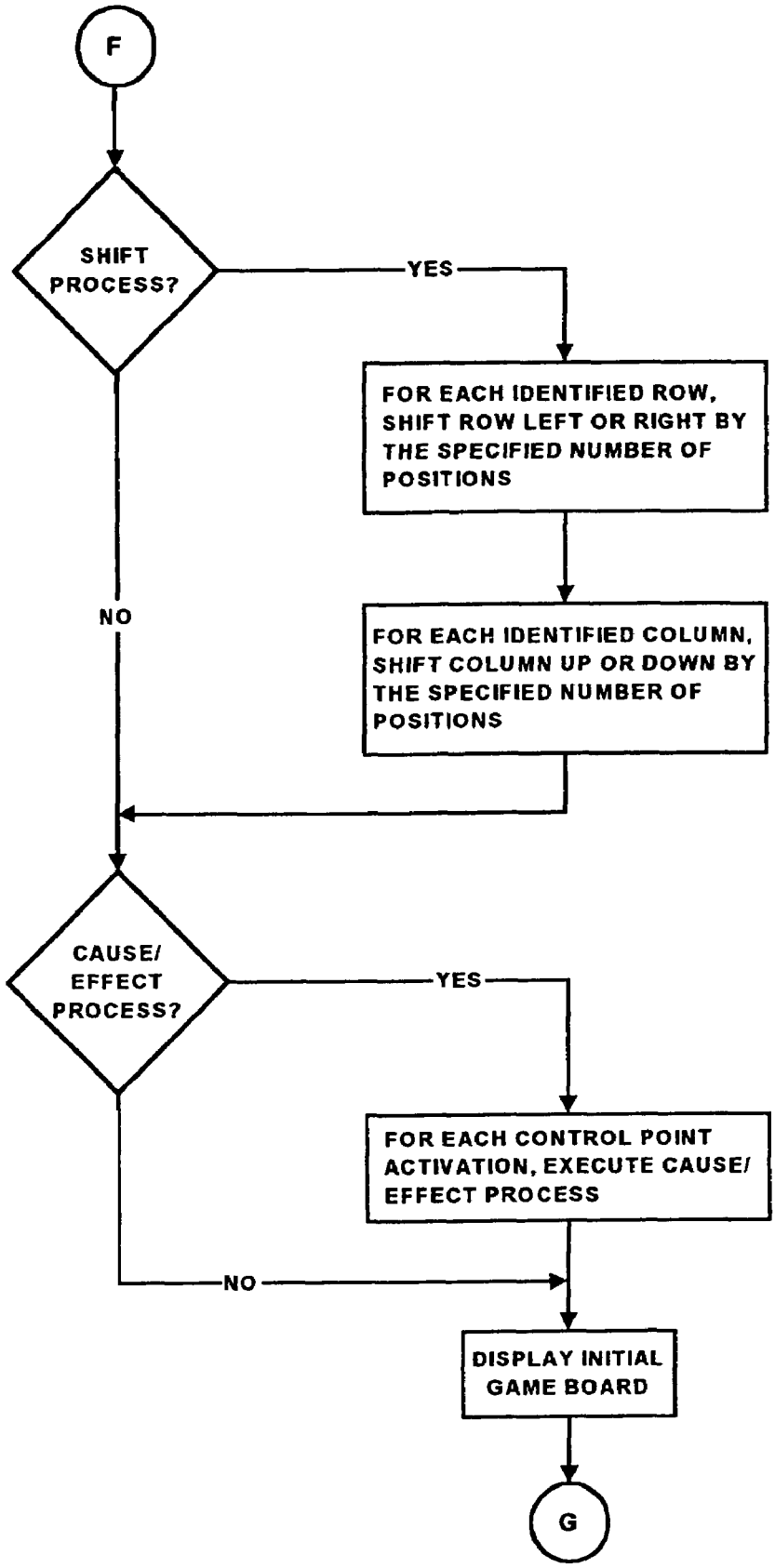
Figure 12:
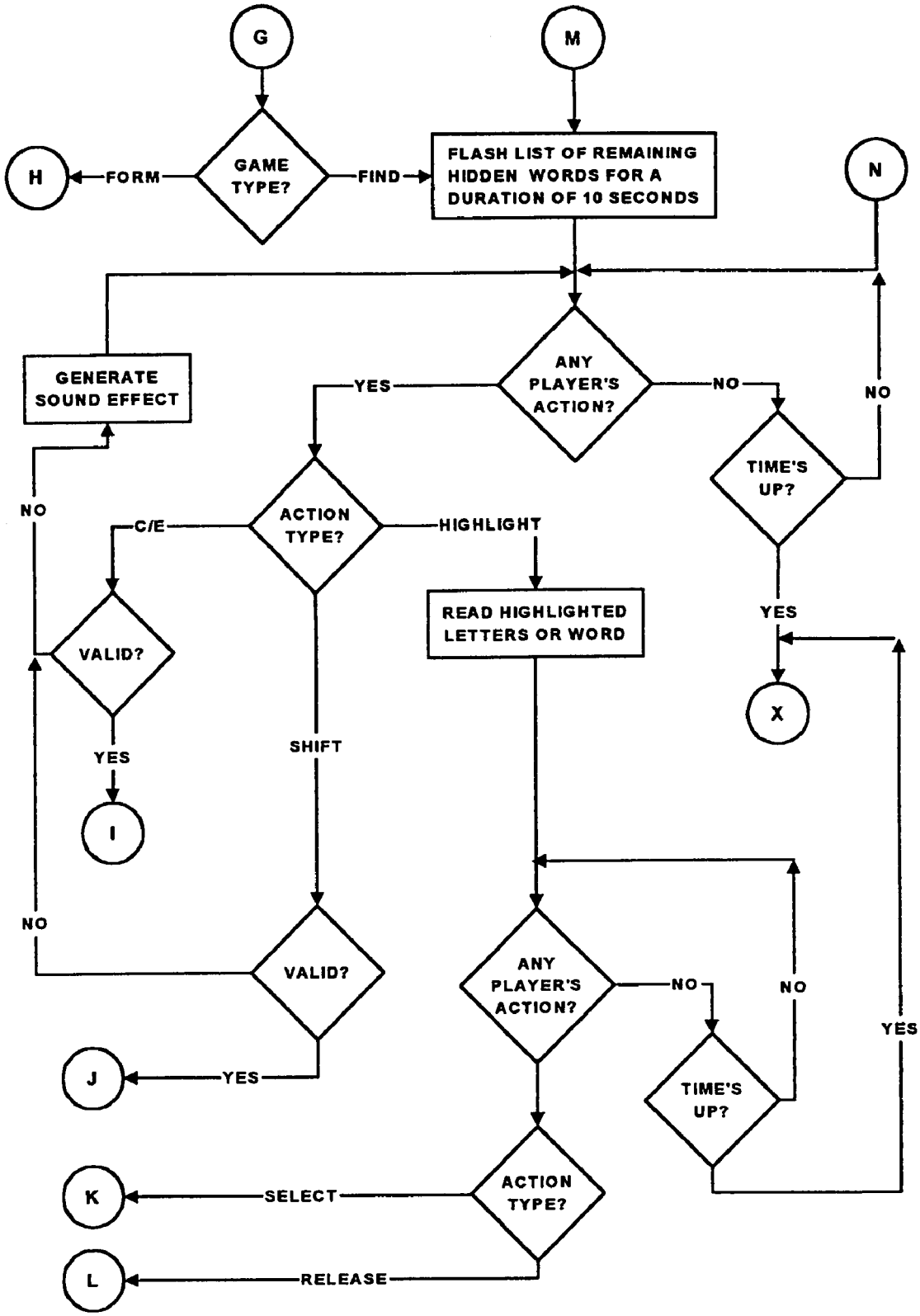
Figure 13:
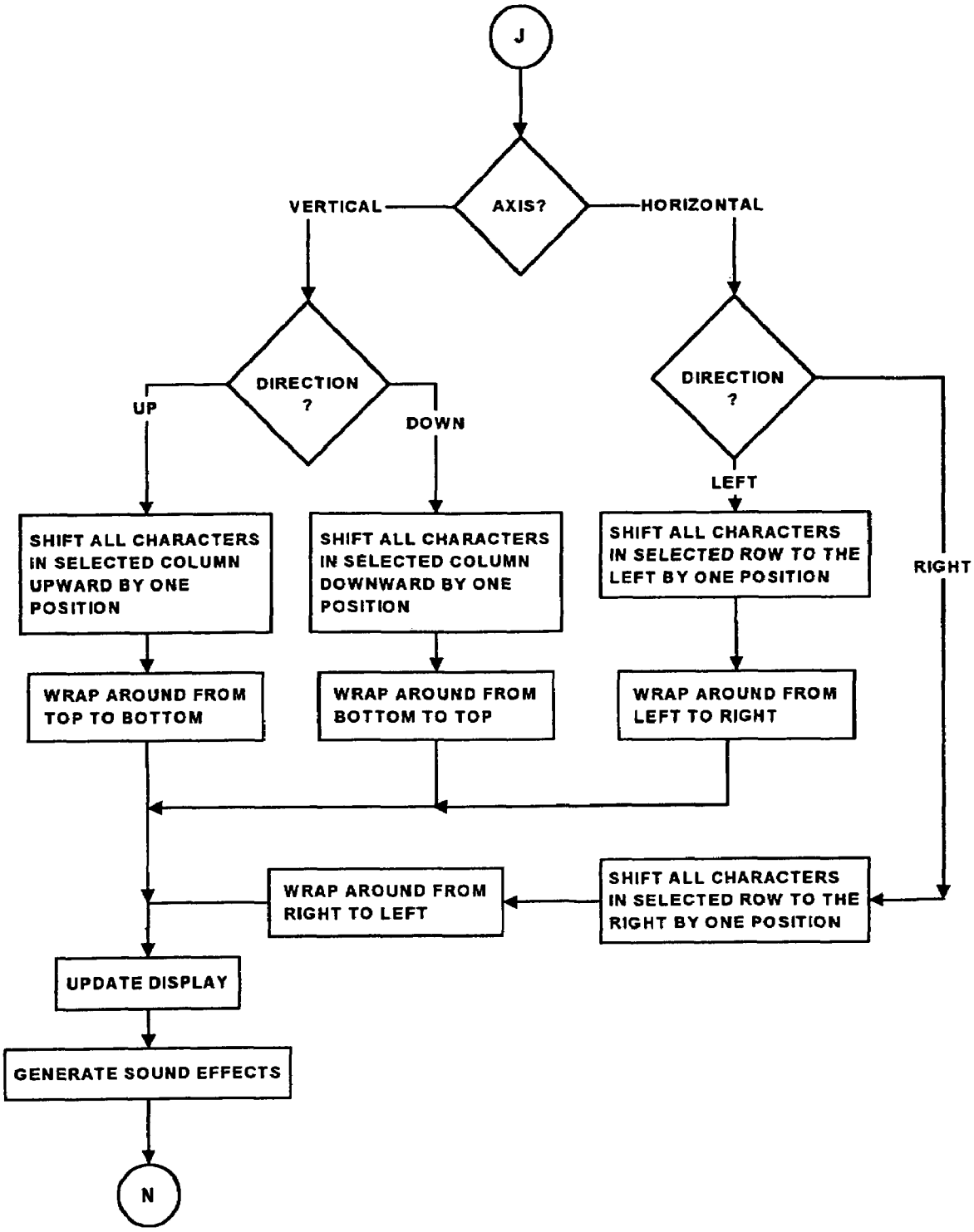
Figure 14:
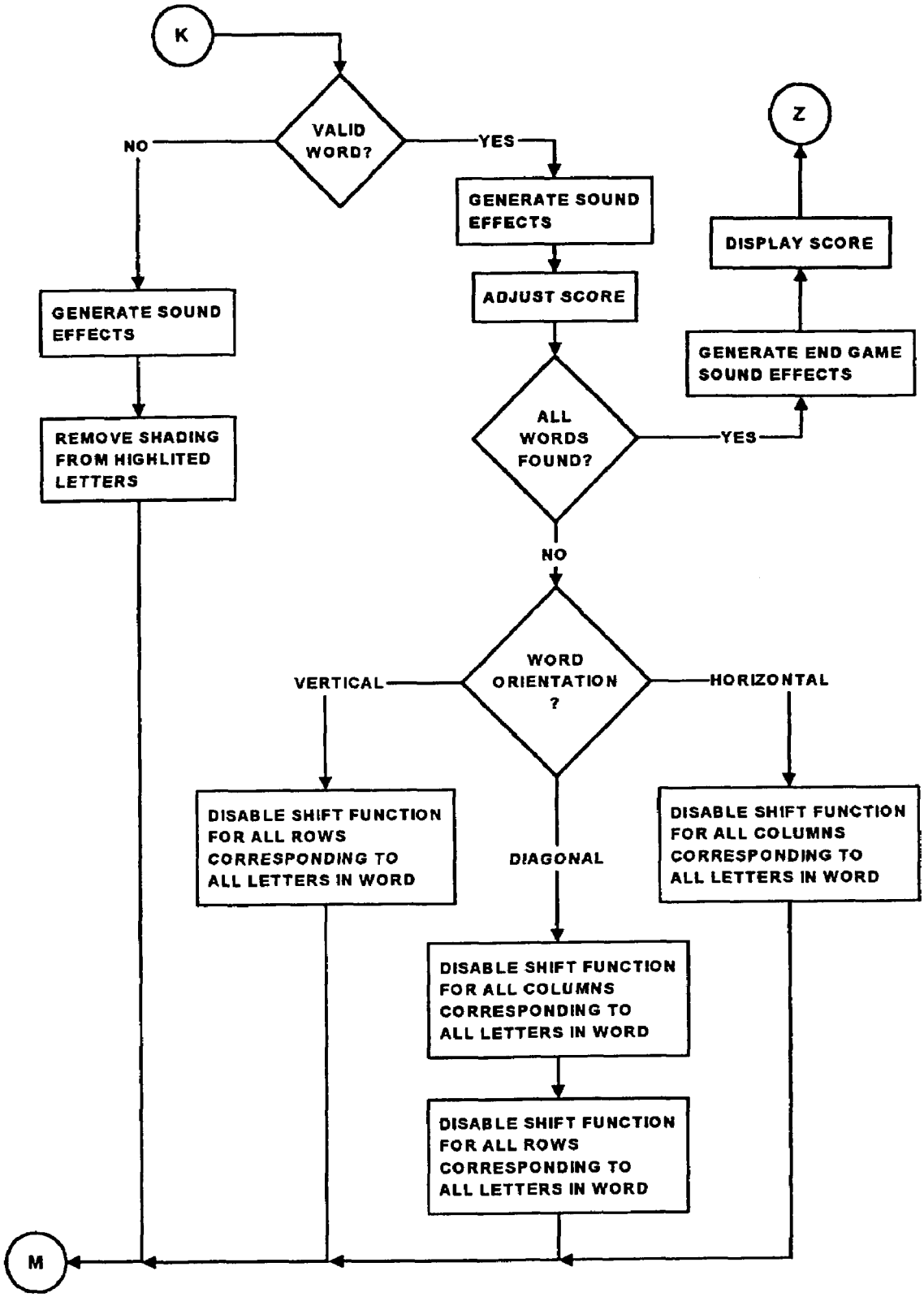
Figure 15:
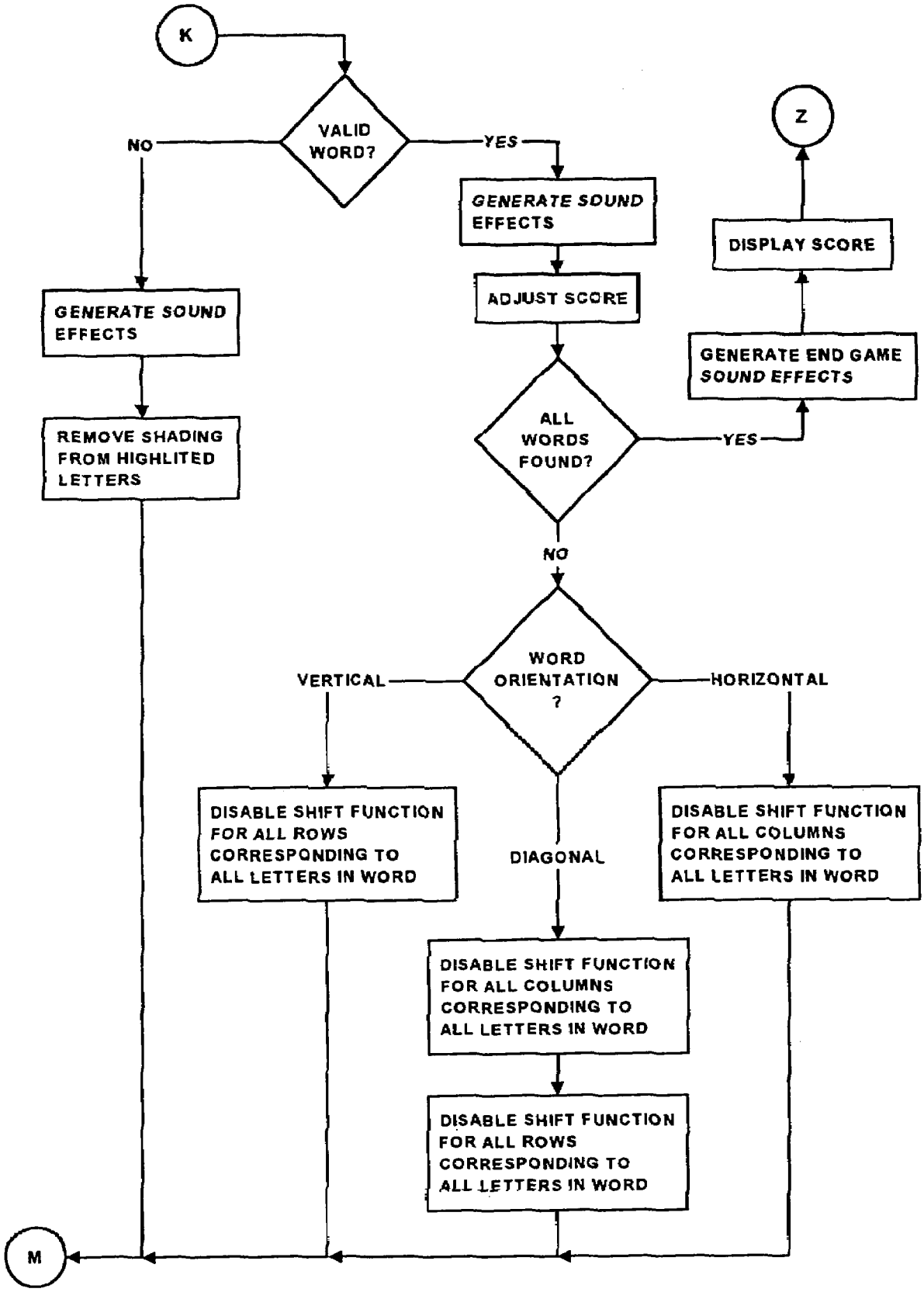
Figure 16:
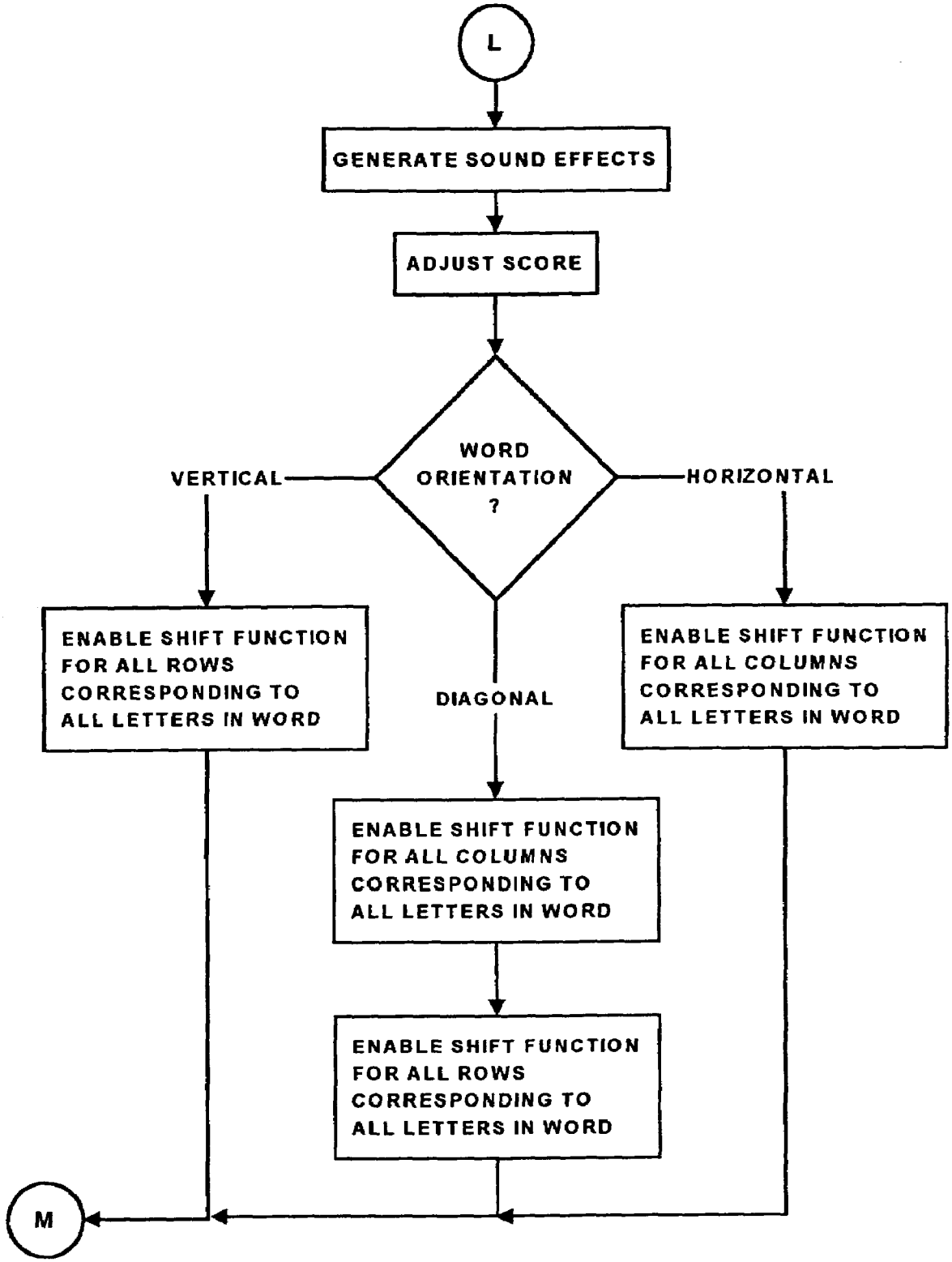
Figure 17:
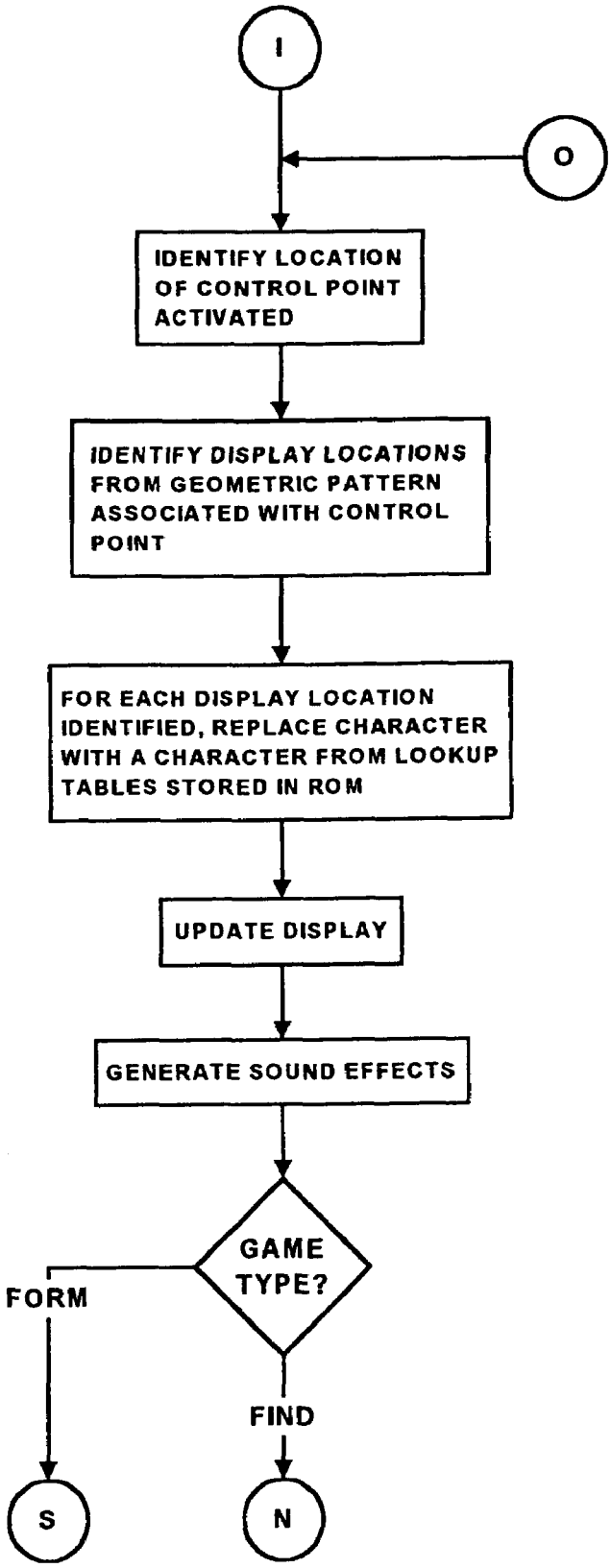
Figure 18:
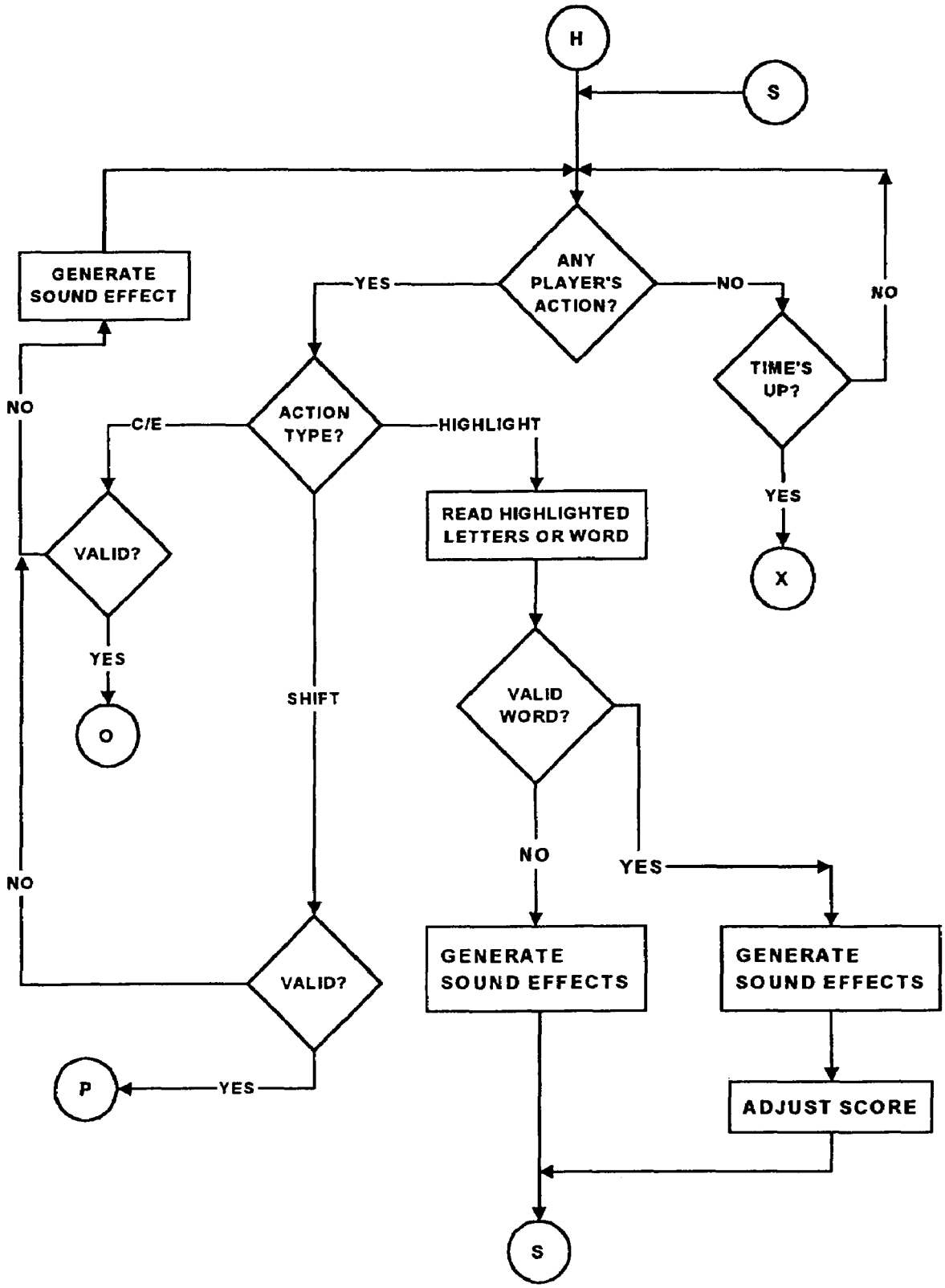
Figure 19:
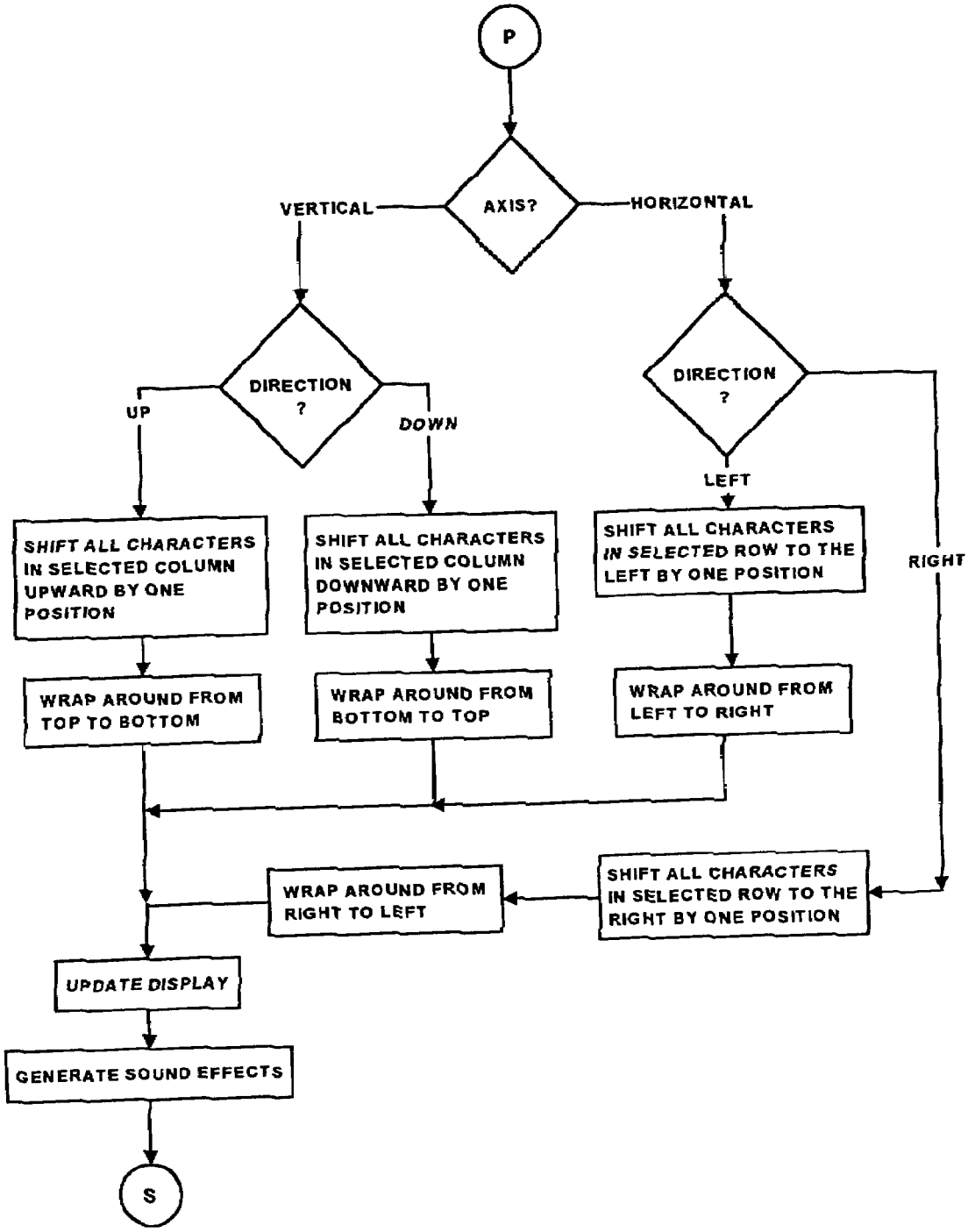
Figure 20:
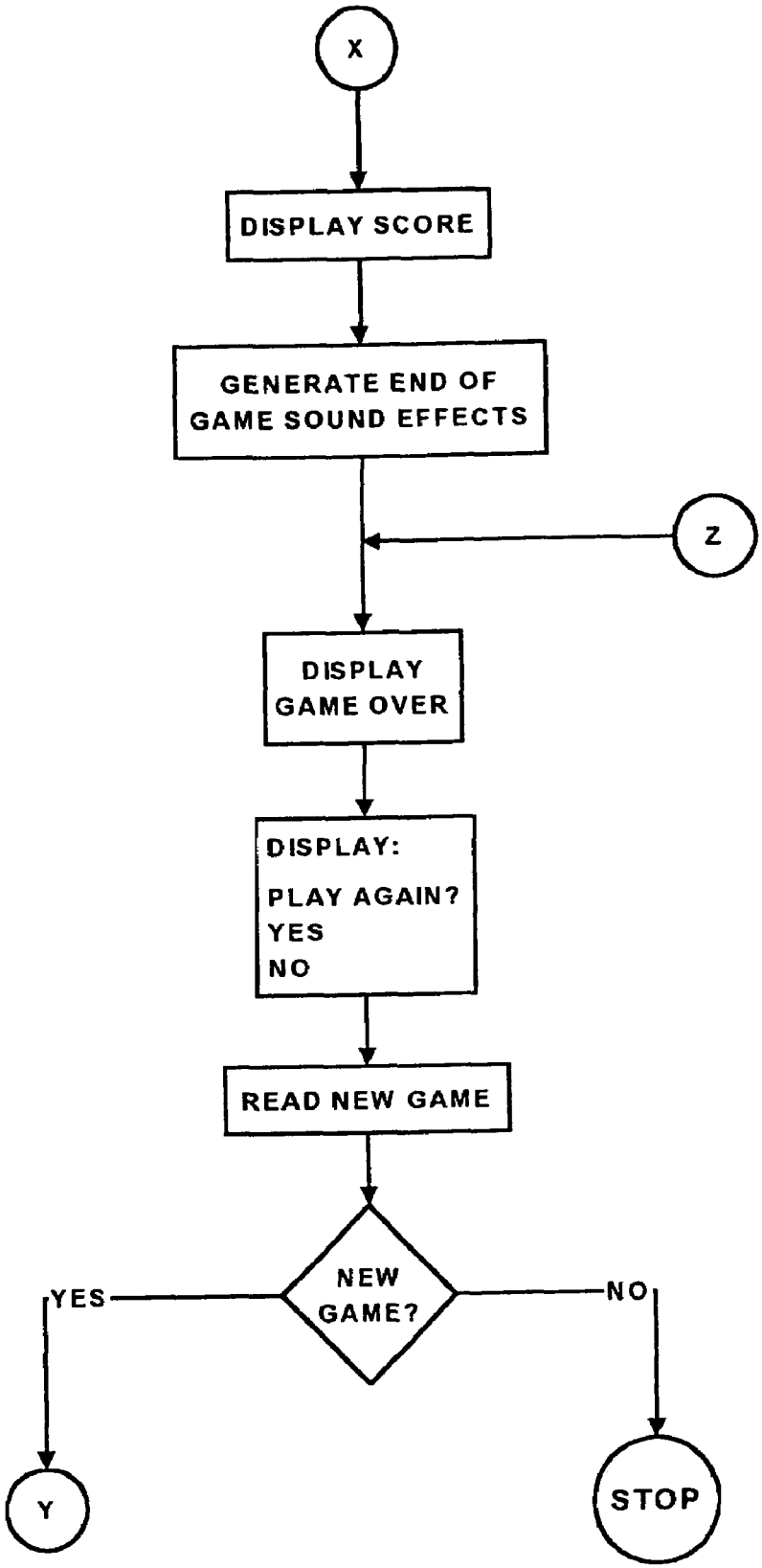
Figure 21:
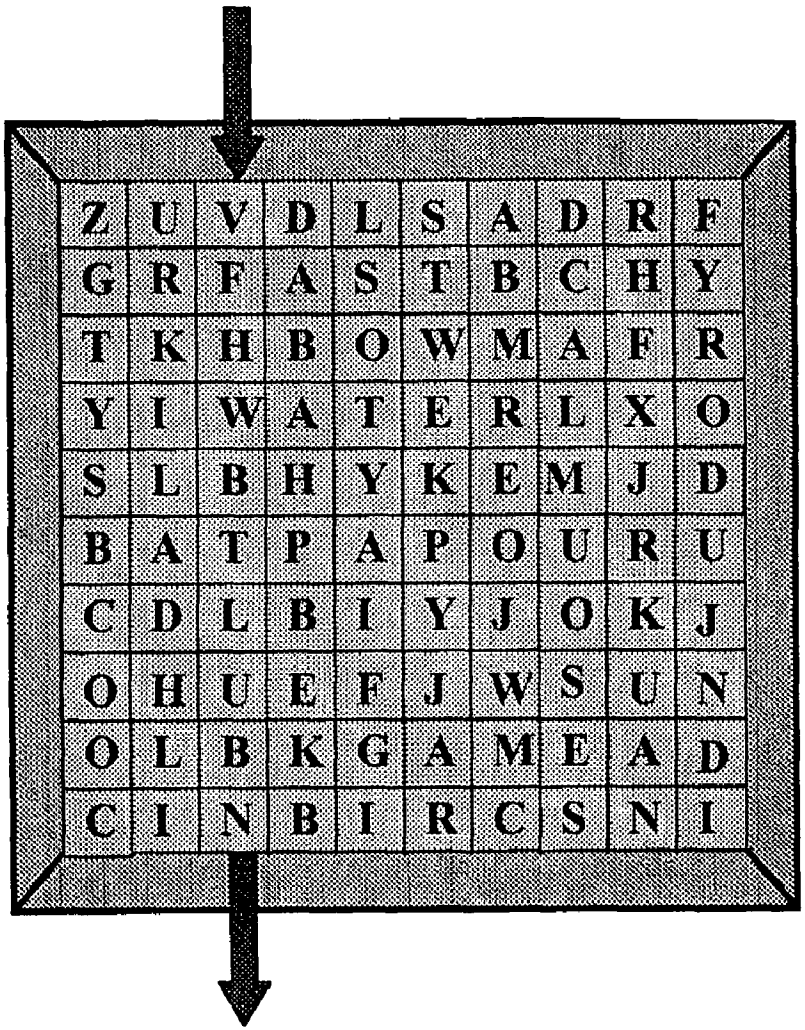
FIGS. 21-24 depict a sequence of displays for a step-by-step example to form an initial game display from an initial configuration of letters, using the logical process of shifting rows and/or columns.
Figure 22:
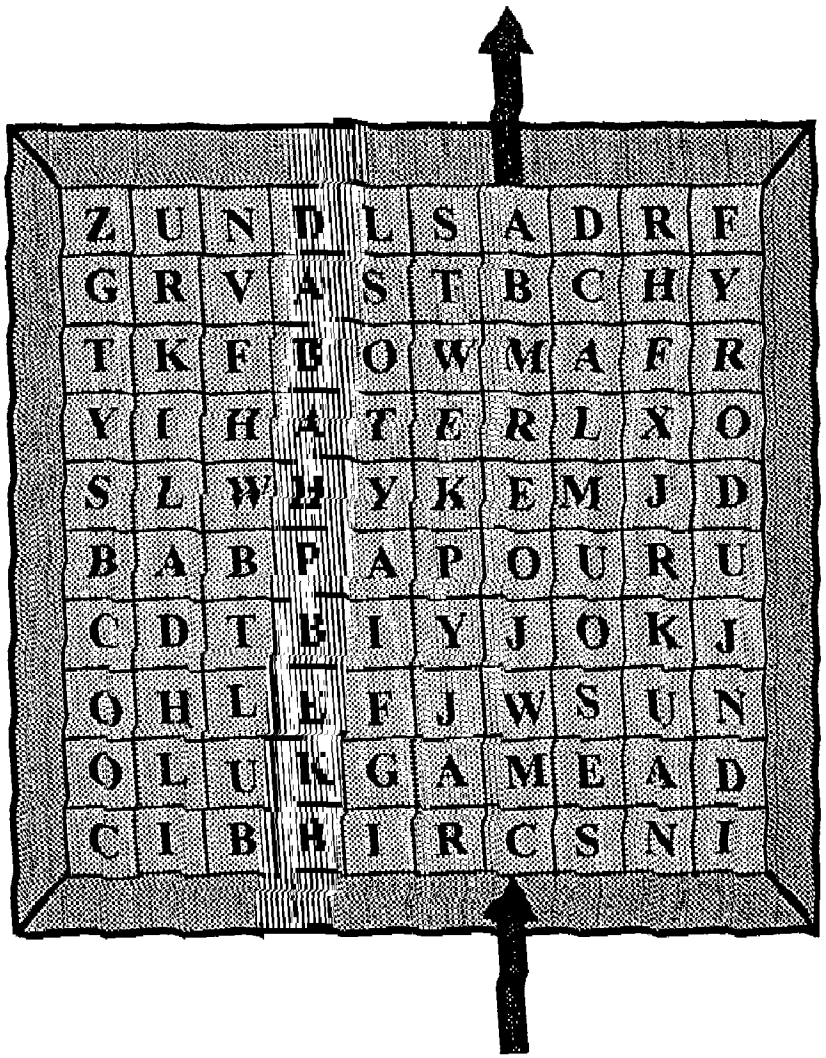
Figure 23:
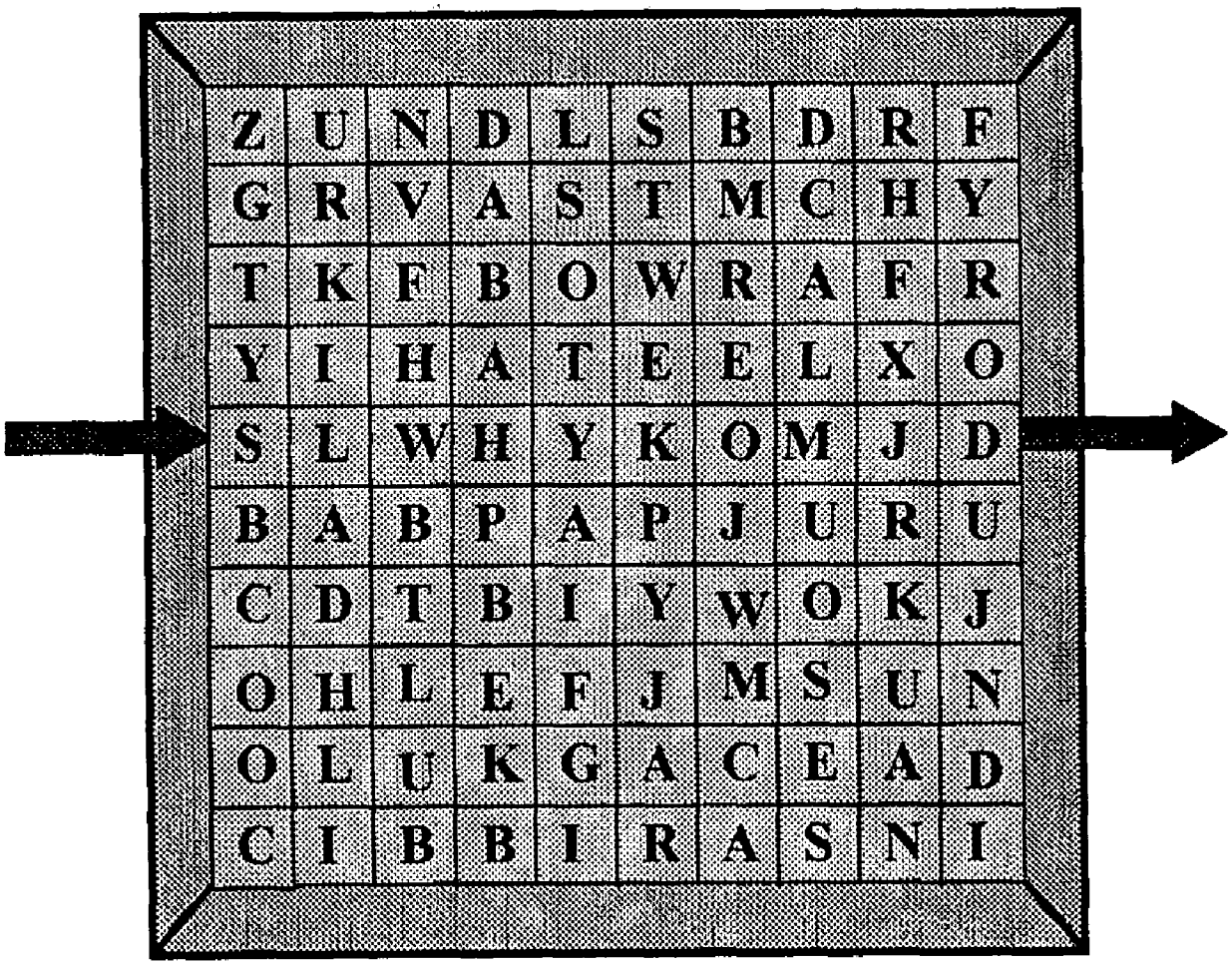
Figure 24:
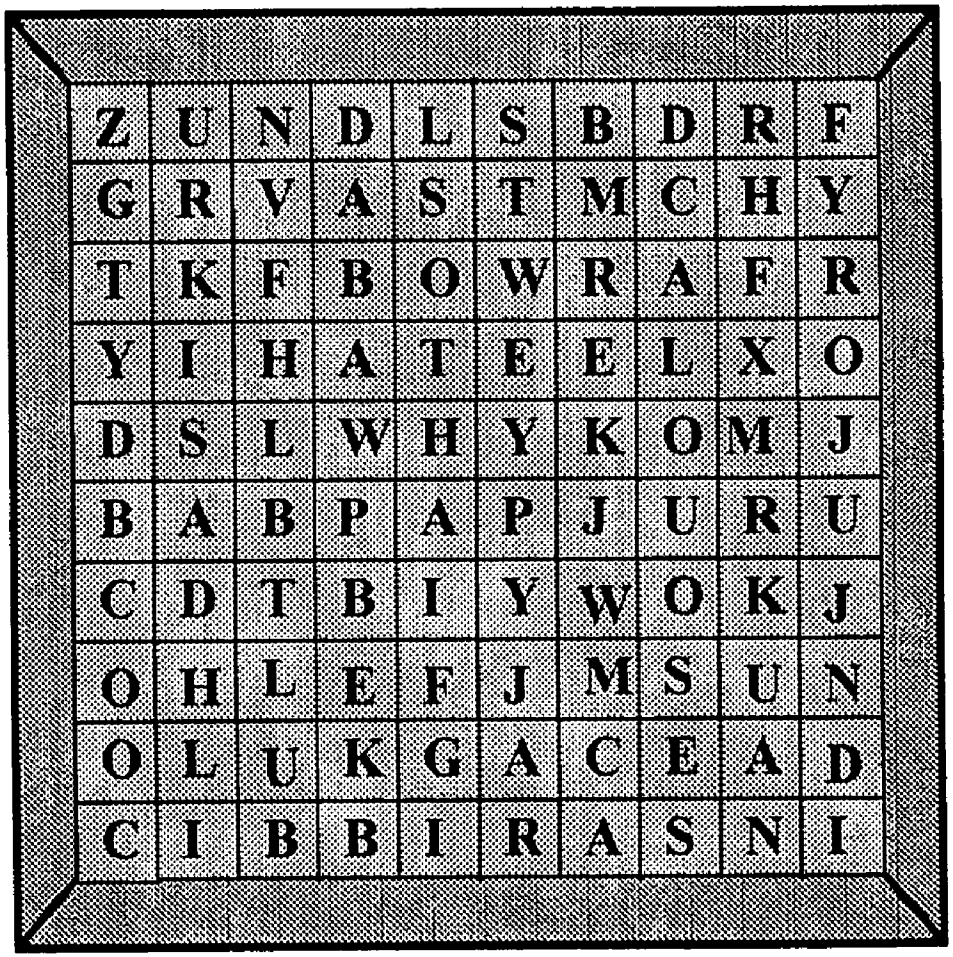

A block diagram of the control circuitry for this game device 10 is illustrated in FIG. 6. This control circuitry includes a central processing unit 60 having a control program memory 62 associated therewith, a read only memory (ROM) or a FLASH memory 62, a random access memory (RAM) 64, an interface and coding device 38, an LCD driver 54, and audio interface and control circuits (audio driver) 58.

The interface and coding device 38 is used as input interface between the various control push buttons 18, 20, 21, 22, 24 & 28 and the central processing unit 60. In contrast, the LCD driver 54 is used as an output interface between the central processing unit 60 and the LCD screen 22. Similarly, the audio driver 58 is used as output interface between the central processing unit 60 and the loudspeaker 76. A common address and control bus 92, and a separate common data bus 90 are used to interconnect the central process unit 60 with the interface and coding device 38, the LCD driver 54, the audio driver 58, the read only memory (ROM) 62, the random access memory (RAM) 64, and an external memory device 94 that contains additional games.

It should be noted that the above description of the control circuit of the device is provided as an example for illustration purposes only, and is not intended to limit the present invention. As would be obvious to those skilled in the art, a game designer would most likely select a micro-controller with built-in audio and LCD drivers to control the game device. Such micro-controller would include I/O ports that can be configured as input or output ports, and would be used to connect the control point switches and other control push buttons directly to the micro-controller without the need for any interface and coding devices or memory decoder drivers. Such micro-controllers are well known to those skilled in the art.

The central processing unit 60 controls the flow of all information throughout the entire system under the direction of the control program. The control program resides in the read only memory (ROM) 62. A plurality of dry cell batteries 82 is positioned in the housing beneath the LCD screen 22. The batteries 82 provide power for the central processing unit 60 as well as the LCD screen 22.

With respect to the operation of the device, the logic steps utilized for the preferred embodiment are illustrated in flow diagram form in FIGS. 7 through 20, which interconnect with each other at the places shown in the various figures. Even though specific reference will not be made to this diagram in the following description of the operation of the device, periodic reference to this diagram may prove to be helpful to the reader hereof.

Referring again to FIG. 6, in order to operate the device, the player moves the off-on switch 16 from the "off" position to the "on" position which causes power to be supplied to all terminals of the device 10 from either a battery 82 or some external power source and which causes a pulse generator 84 to generate a reset pulse. This pulse is applied to the central processing unit 60 and causes the central processing unit 60 to clear any data remaining in the RAM 64 and in the audio and LCD drivers 58 & 54 over the common data bus 90. The pulse also causes the central processing unit 60 to display a game introduction graphic on the LCD screen, and to generate sound and visual effects. Then the control program will cause the microprocessor to query the player by displaying a series of questions on the LCD screen related to the type of game, the scramble process and the difficulty level of play.

The preferred embodiment includes two different games. The first game is called "Find a Word," and is based on a game objective of finding predetermined words hidden in the field of play. For the preferred embodiment, the field of play consists of a 12×12 display matrix forming a total of 144 display positions. Each display position indicates one letter of an alphabet. For the preferred embodiment the English set of alphabet is used. A game is defined, in part, by a first game parameter that consists of an initial configuration of 144 letters placed on the 12×12 display matrix. For a specific game, said initial configuration includes a plurality of predetermined words placed along horizontal, vertical or diagonal axes. For the preferred embodiment, there are 12 vertical axes, 12 horizontal axes, and 42 diagonal axes, each of which consists of two or more display locations.

In order to further hide the predetermined words from the player, the initial configuration of 144 letters is scrambled. Two structures are provided to scramble the initial configuration and generate an initial game display that is presented to the player. The first structure consists of a control logic that shifts an entire row or column by one playing position in a desired direction. When such shift operation is performed, a "wrap around" function is also executed to shift the extreme left, top, right or bottom character to the corresponding opposite side of the playfield. For example, if a "shift to the left" operation is performed on a particular row, then the character at the first position in that row will be shifted to the $12^{th}$ position in the row. Similarly, if a "shift to the top" operation is performed on a particular column, then the character at the first position of that column will be shifted to the $12^{th}$ position of the column. An example that demonstrates how to form an initial game display from an initial configuration of letters, using the logical process of shifting rows and/or columns, is shown in FIGS. 21-24. These figures depict initial, intermediate, and final board displays.

Figure 25:
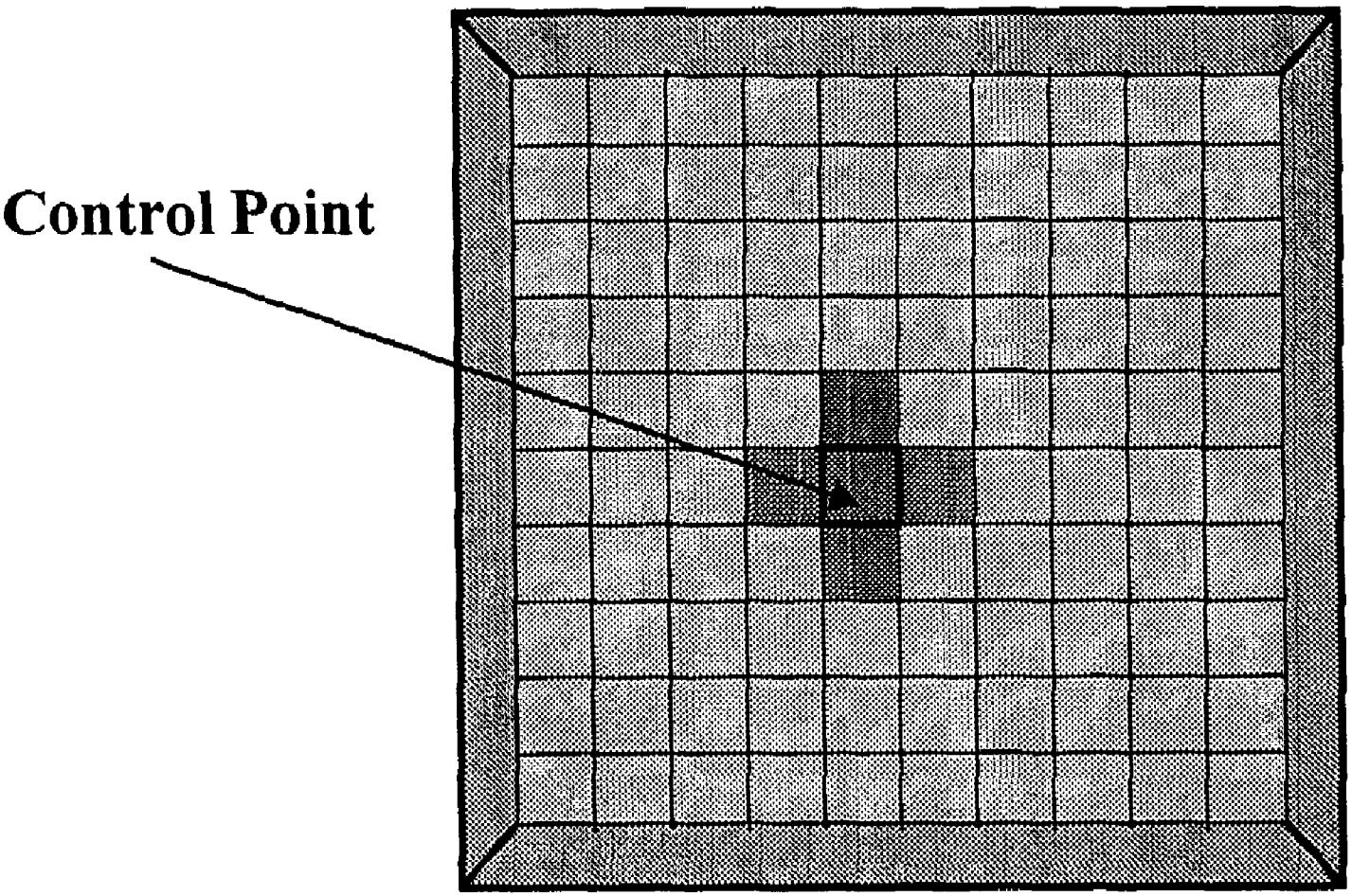
FIGS. 25-28 depict examples of cause/effect relationships associated with control points.
Figure 26:
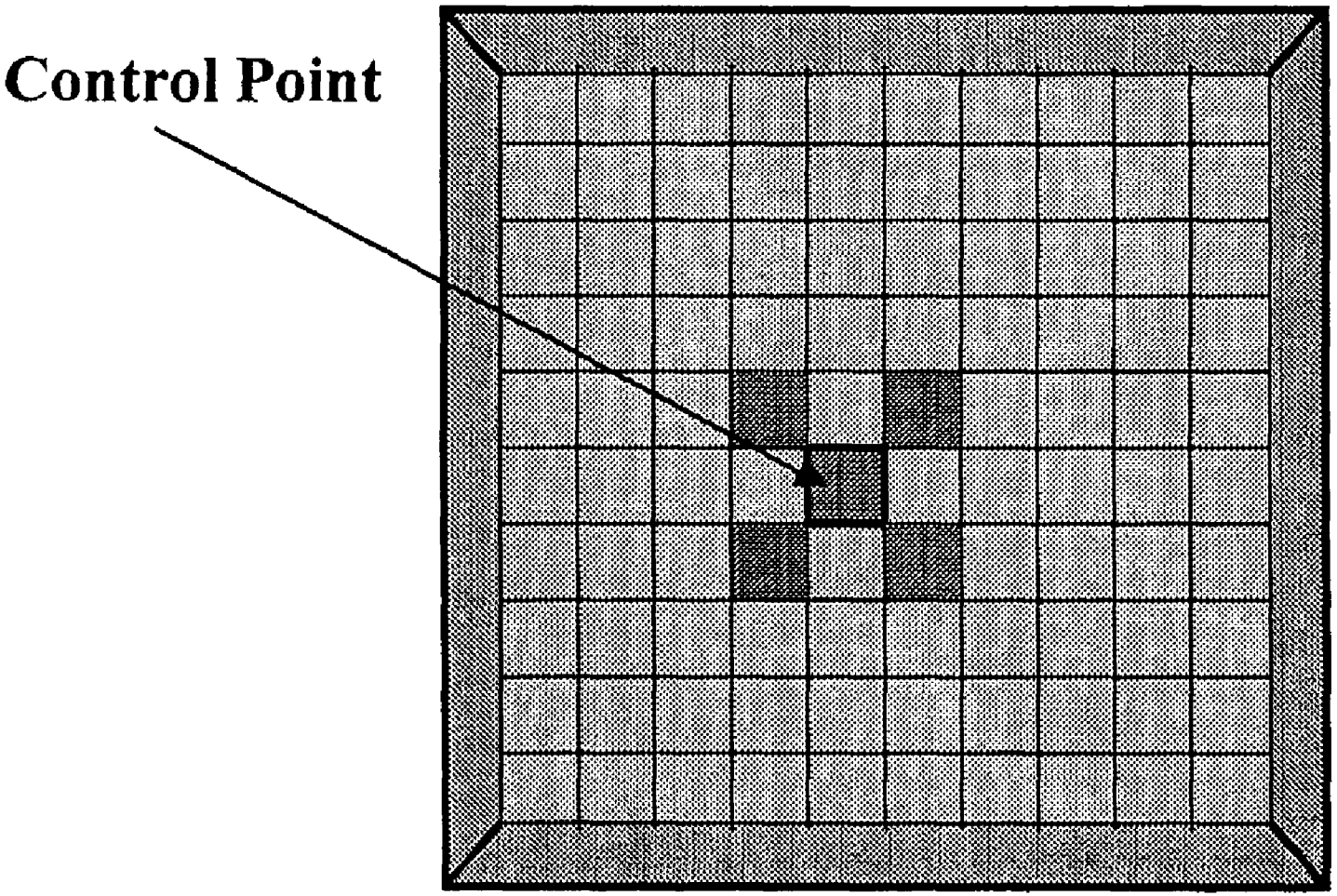
Figure 27:
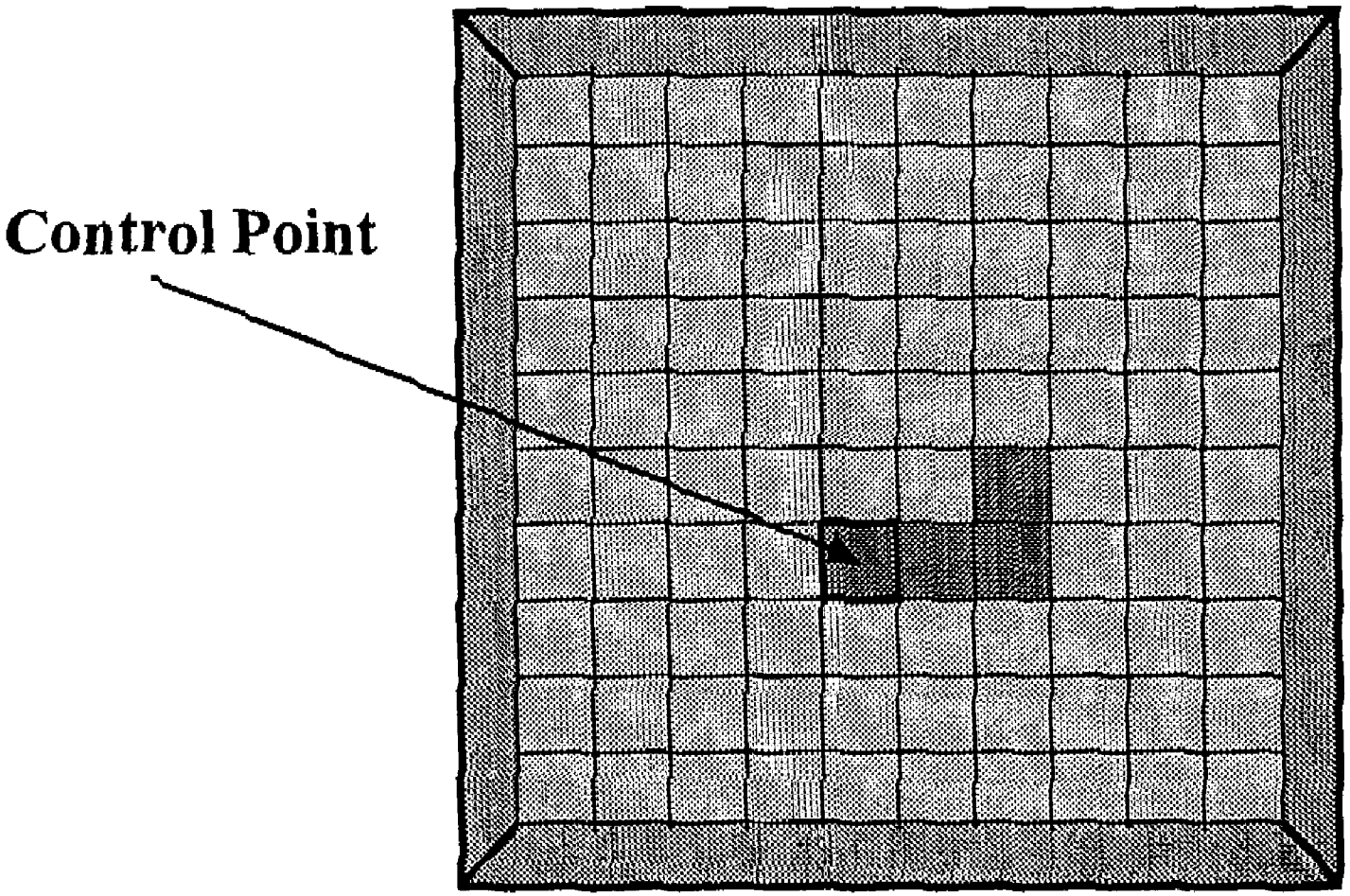
Figure 28:
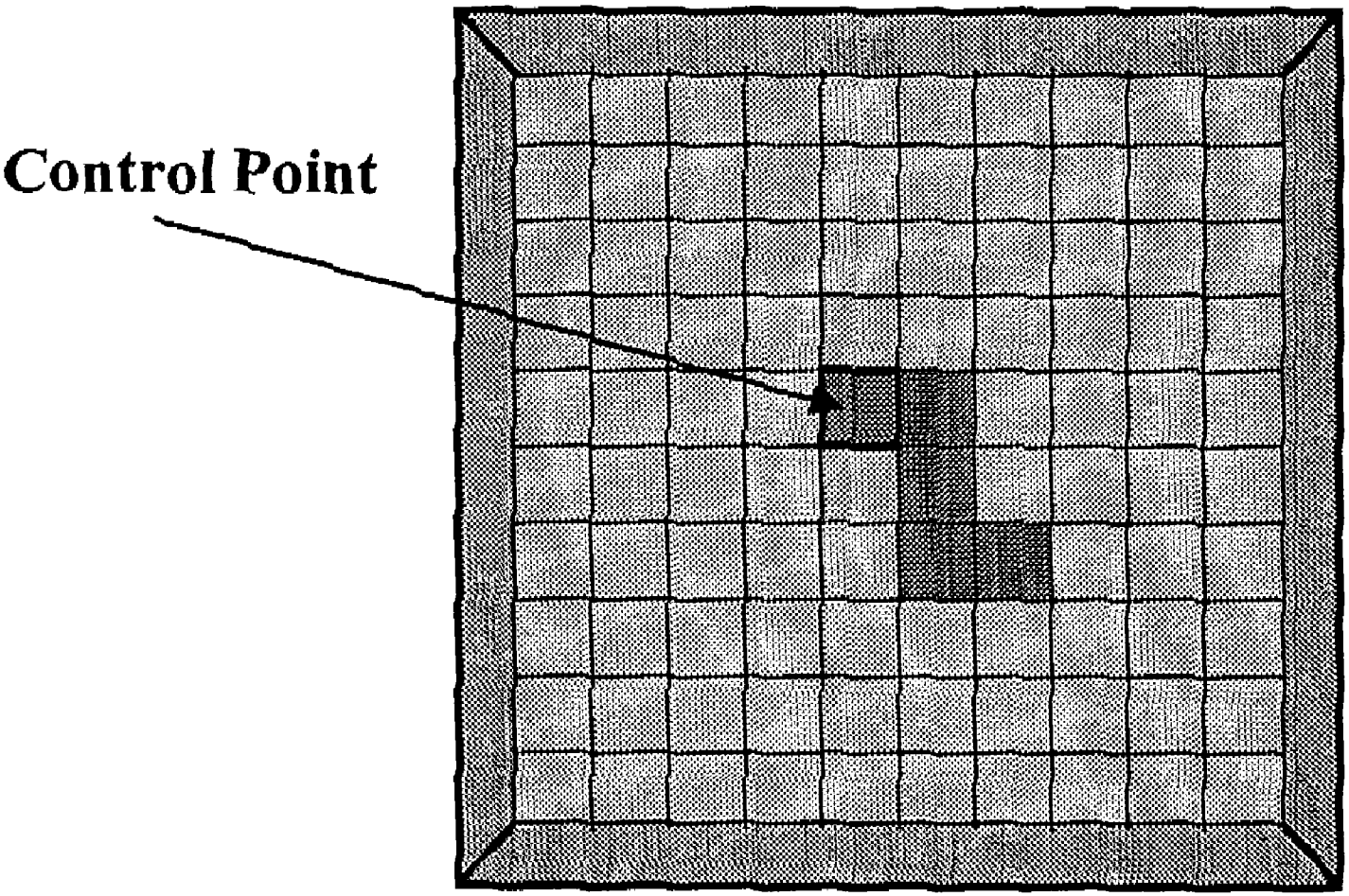

The second structure is based on a cause/effect control logic that results in the replacement of certain characters by different characters based on predefined rules. Said second structure consists of a plurality of switches 21 associated with control points 22 and related cause/effect relationships. A control point is associated with a playing position, and affects the replacement of characters at a predetermined display location, or locations, defined by a geometric pattern relative to the control point. For example, upon the activation of control point 22-(i, j) shown in FIG. 25, the characters at display locations 22-(i−1, j), 22-(i,j+1), 22-(i+1, j) & 22-(i, j−1) are replaced with other characters. A second example of a cause/effect relationship is shown in FIG. 26, where an activation of control point 22–i, j), causes the replacement of characters at display locations 22-(i−1, j−1), 22-(i−1, j+1), 22-(i+1, j−1) & 22-(i+1, j+1). Two additional examples of cause/effect relationship are shown in FIGS. 27 & 28.

Figure 29:
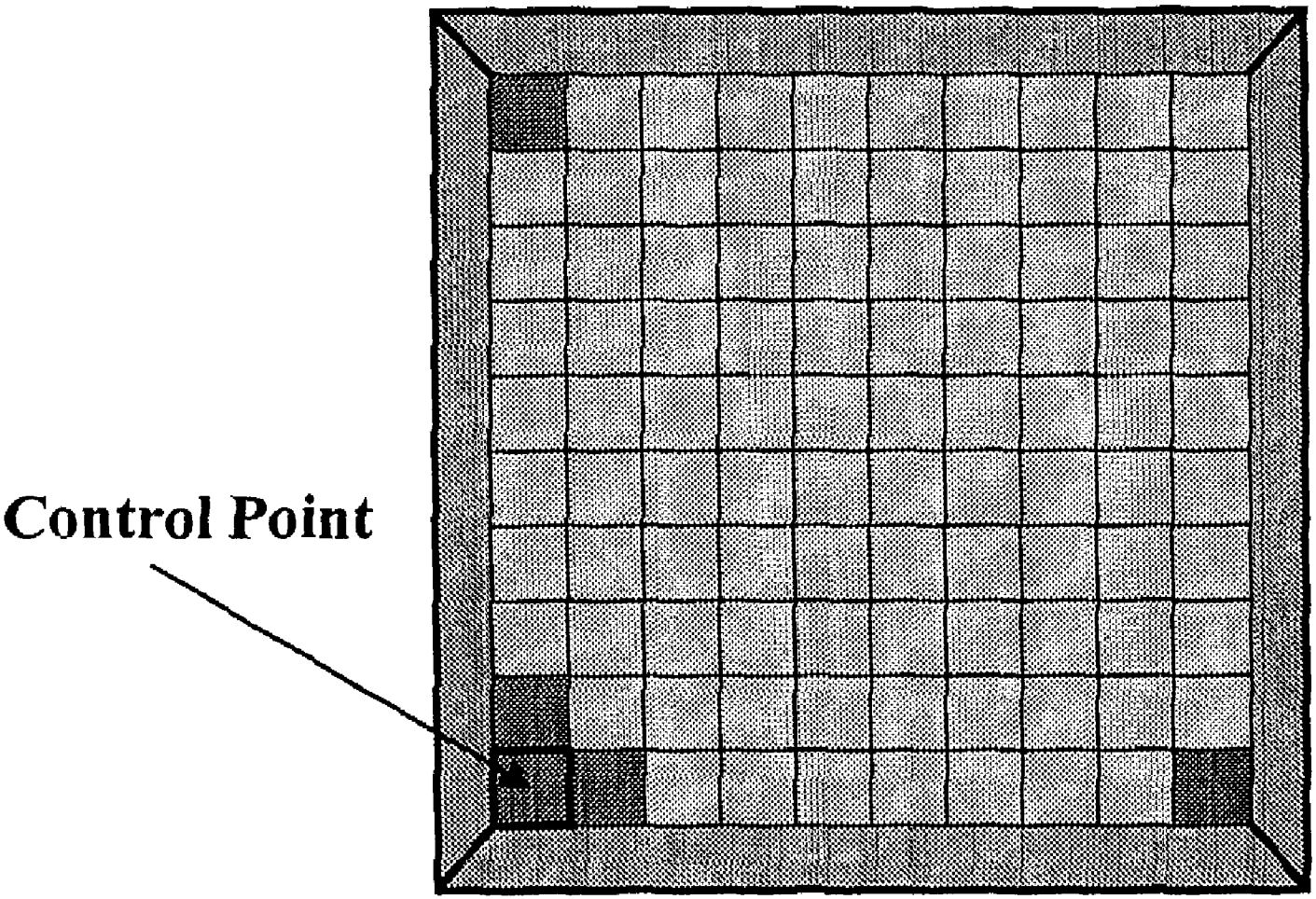
FIGS. 29 & 30 depicts an example of cause/effect relationship for boundary playing positions showing wrap around effect.
Figure 30:
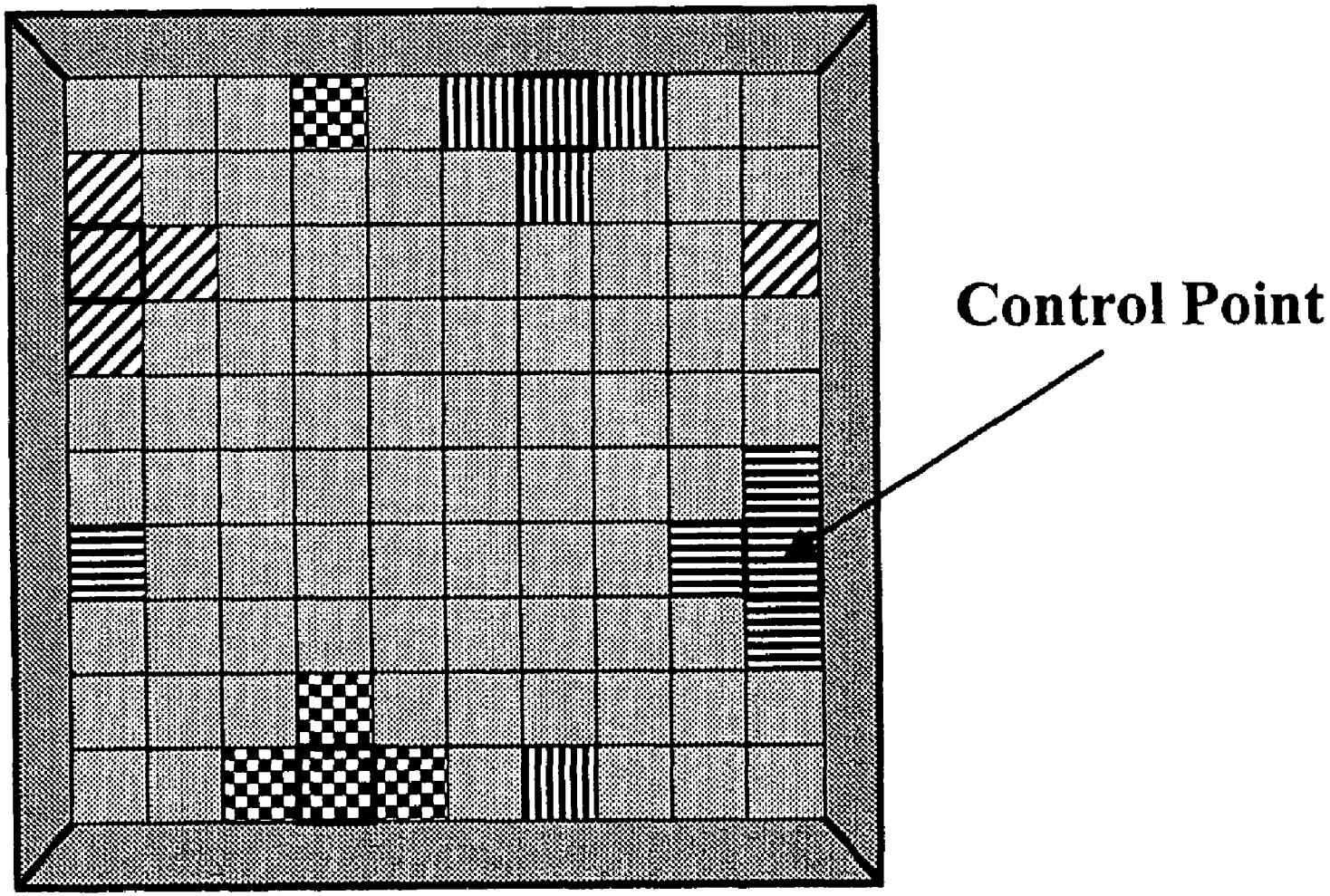
Figure 31:
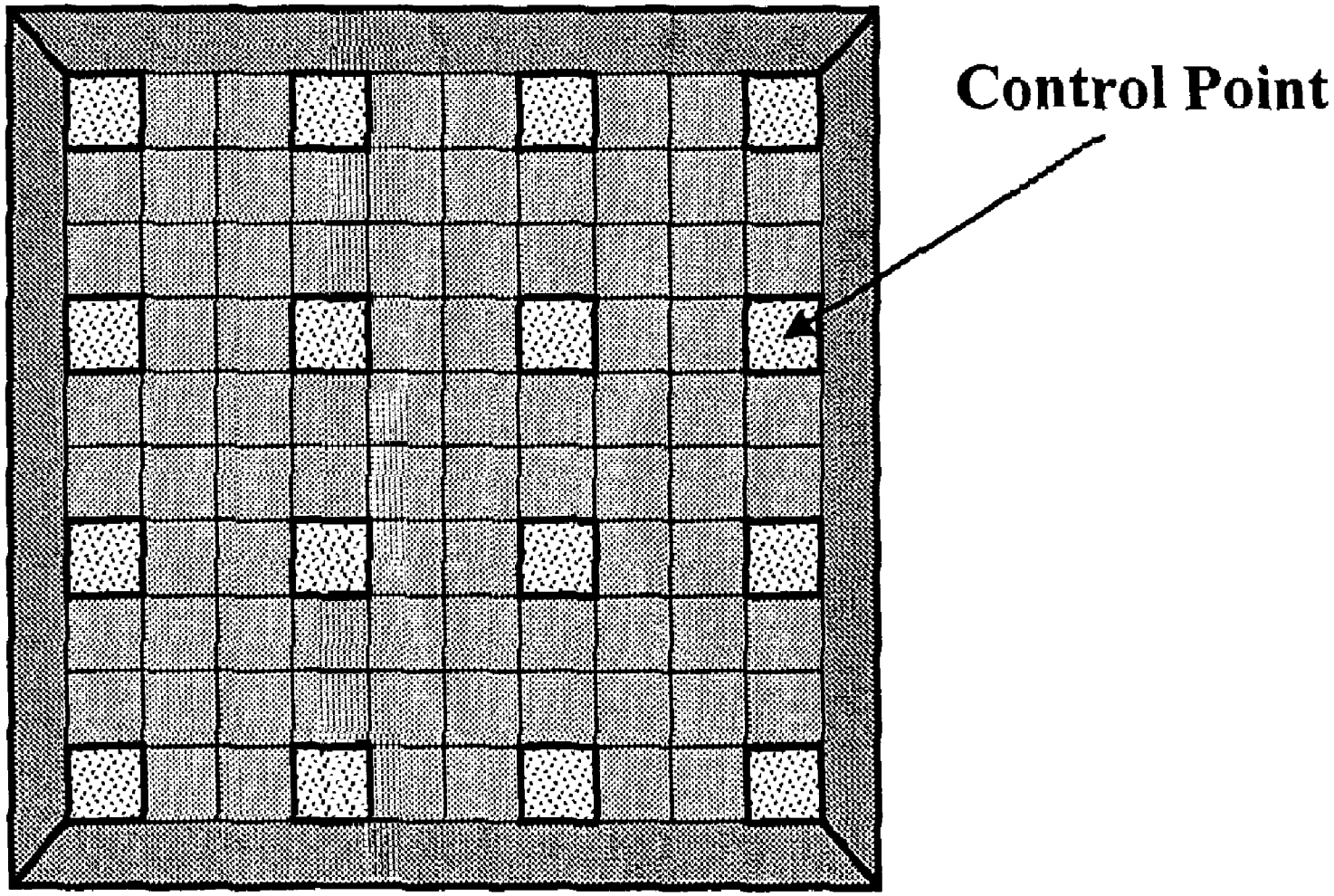
FIGS. 31-33 depict examples of control points associated with a word game.
Figure 32:
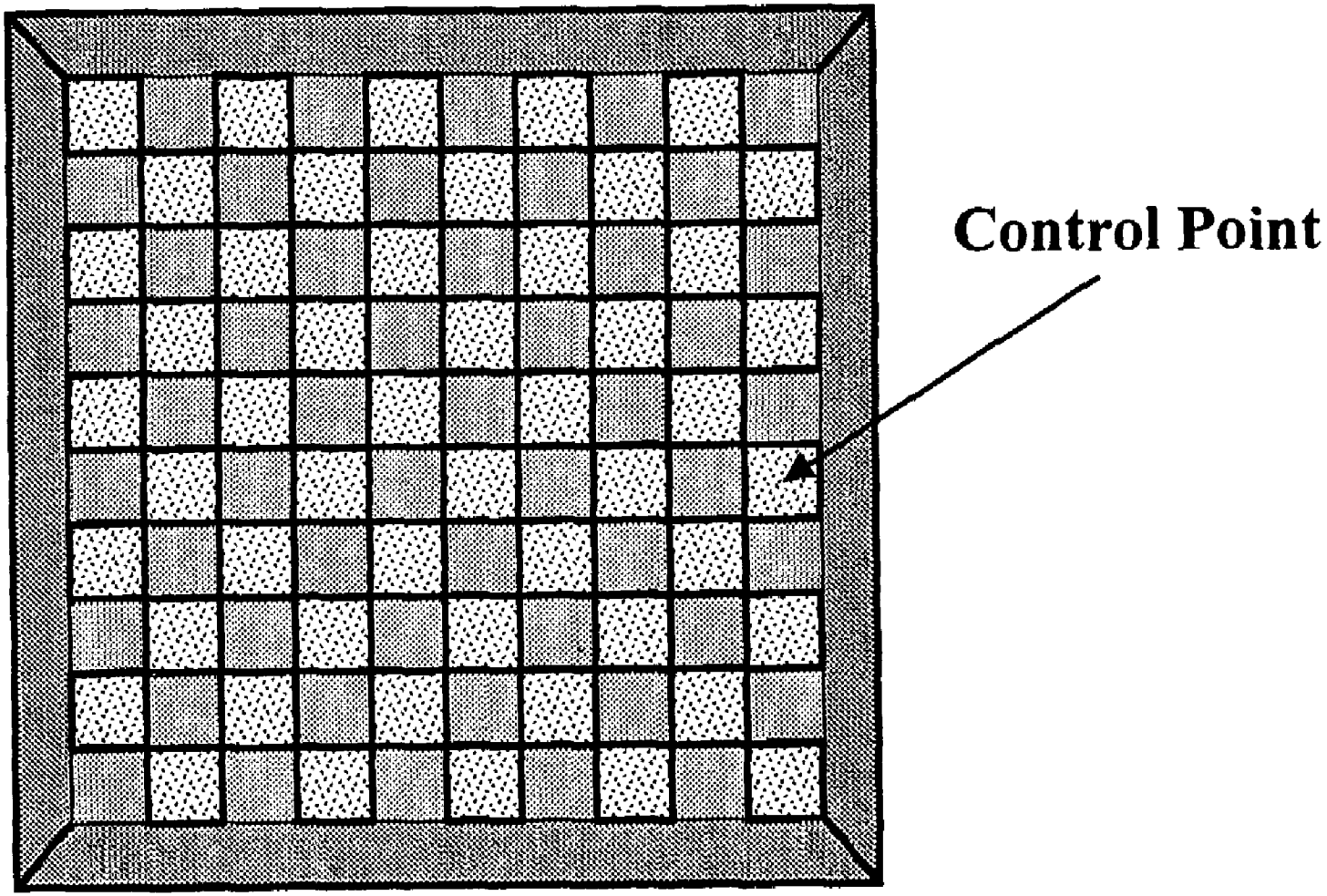
Figure 33:
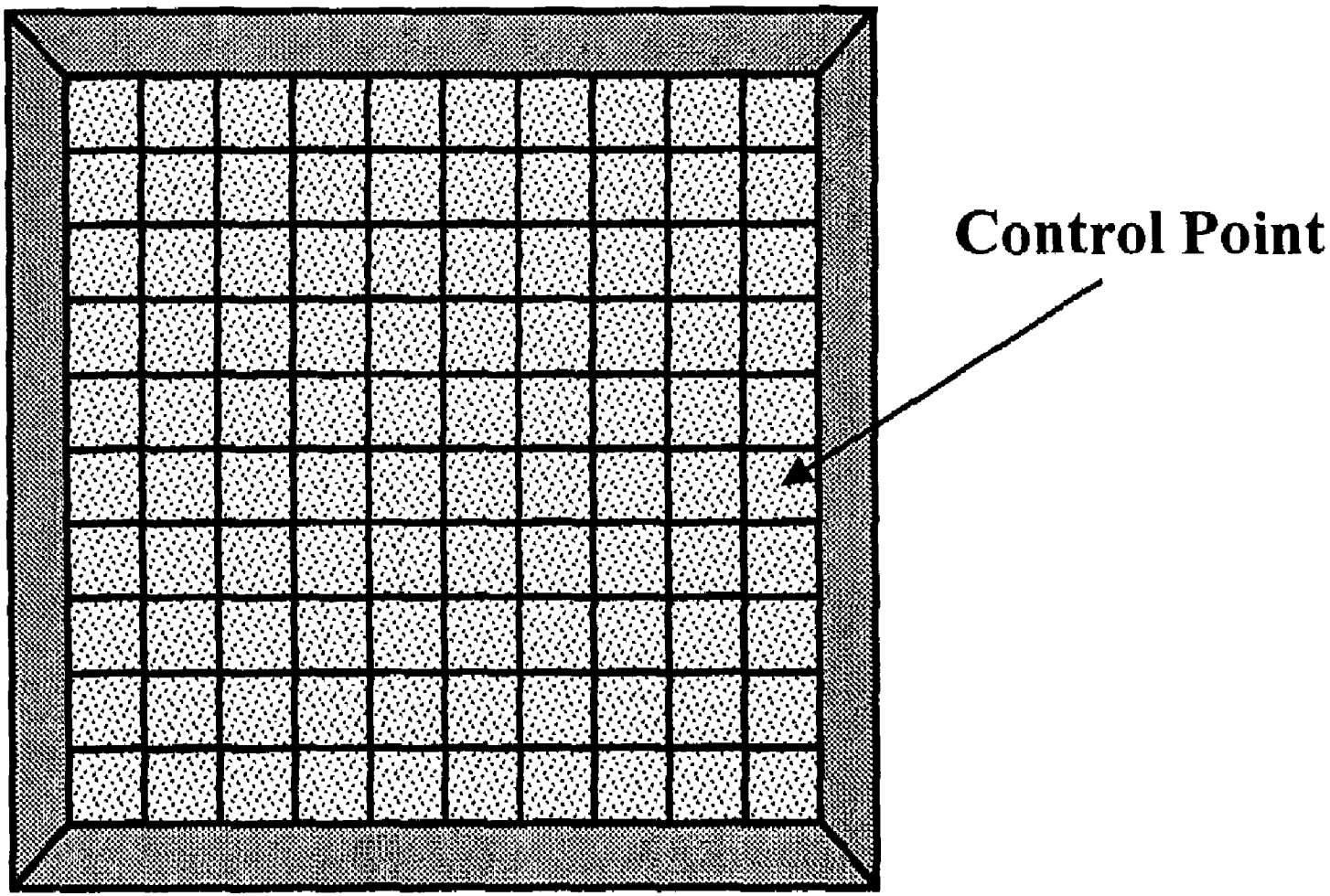
Figure 34:
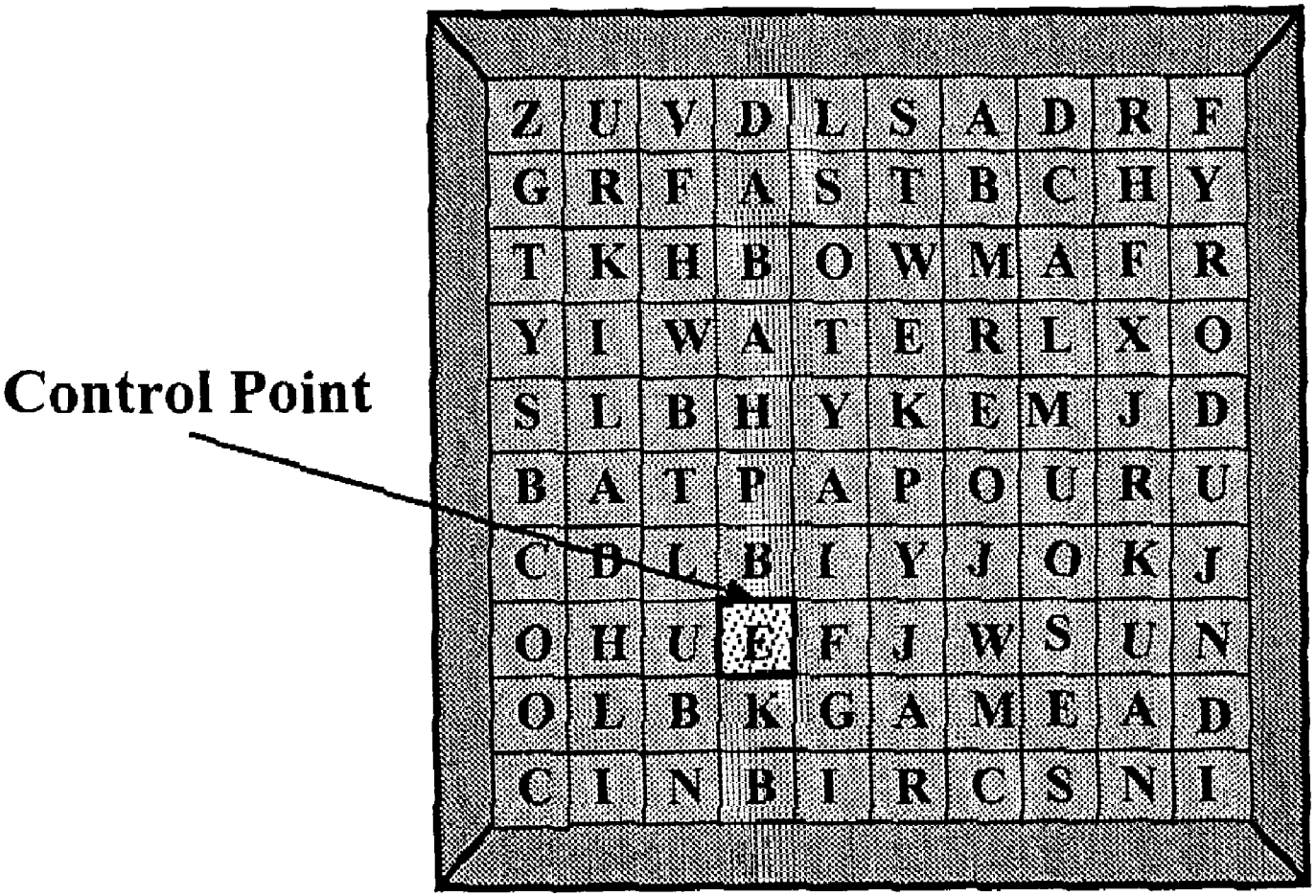
FIGS. 34-38 depict a sequence of displays for a step-by-step example to form an initial game display from an initial configuration of letters, using the cause/effect process, and the letter substitution that employs two logical states for each display position as indicated in FIG. 3.
Figure 35:
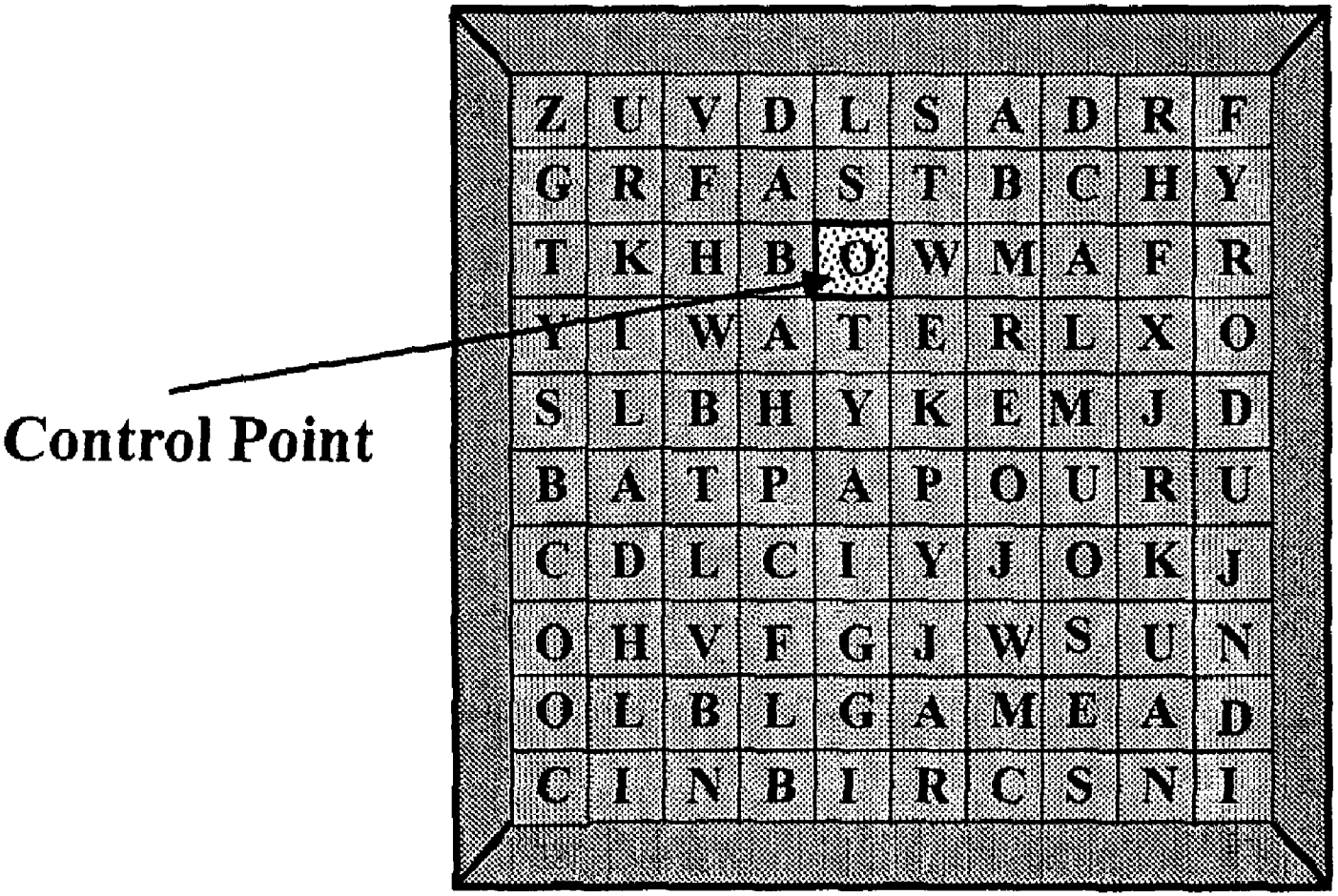
Figure 36:
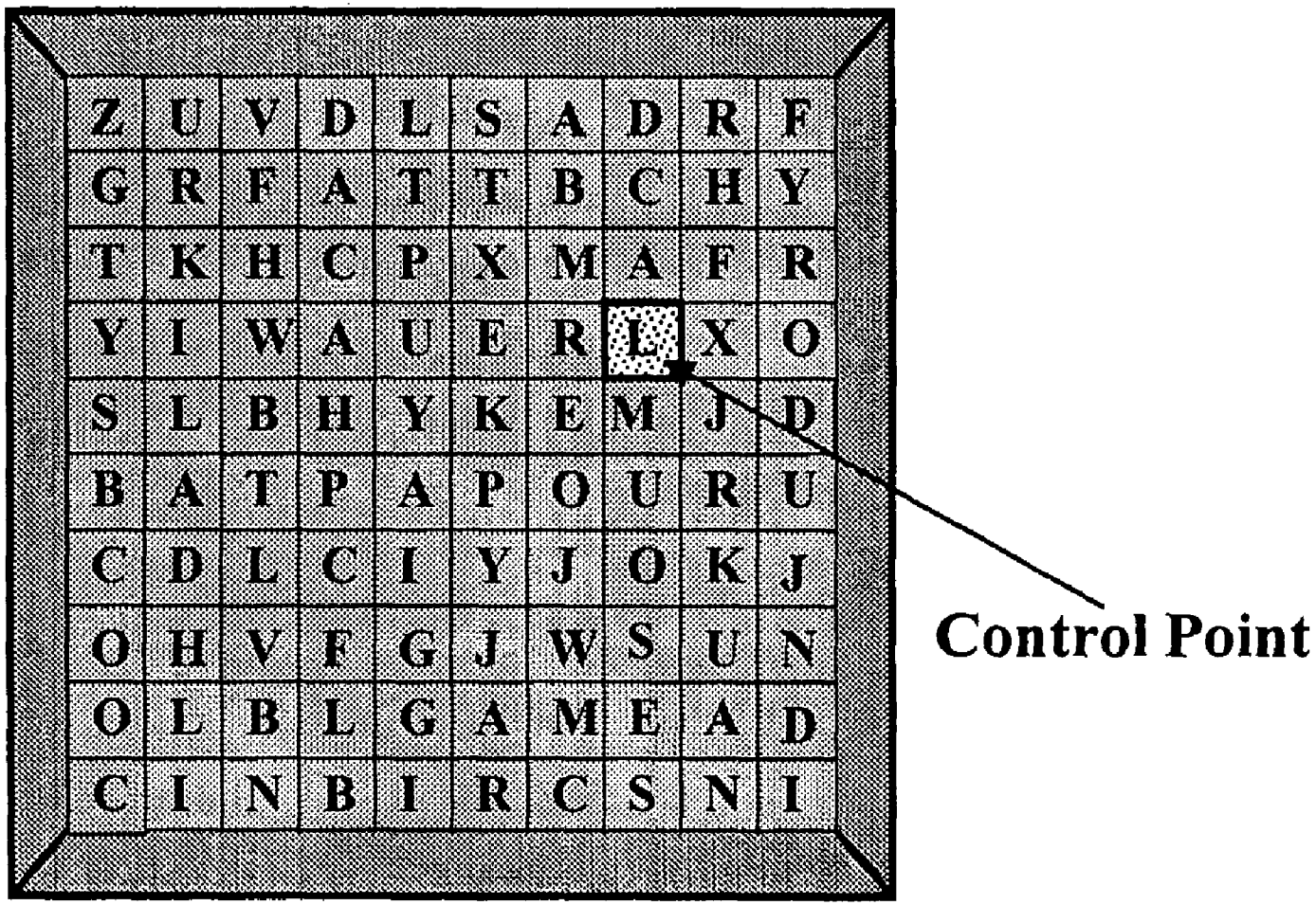
Figure 37:
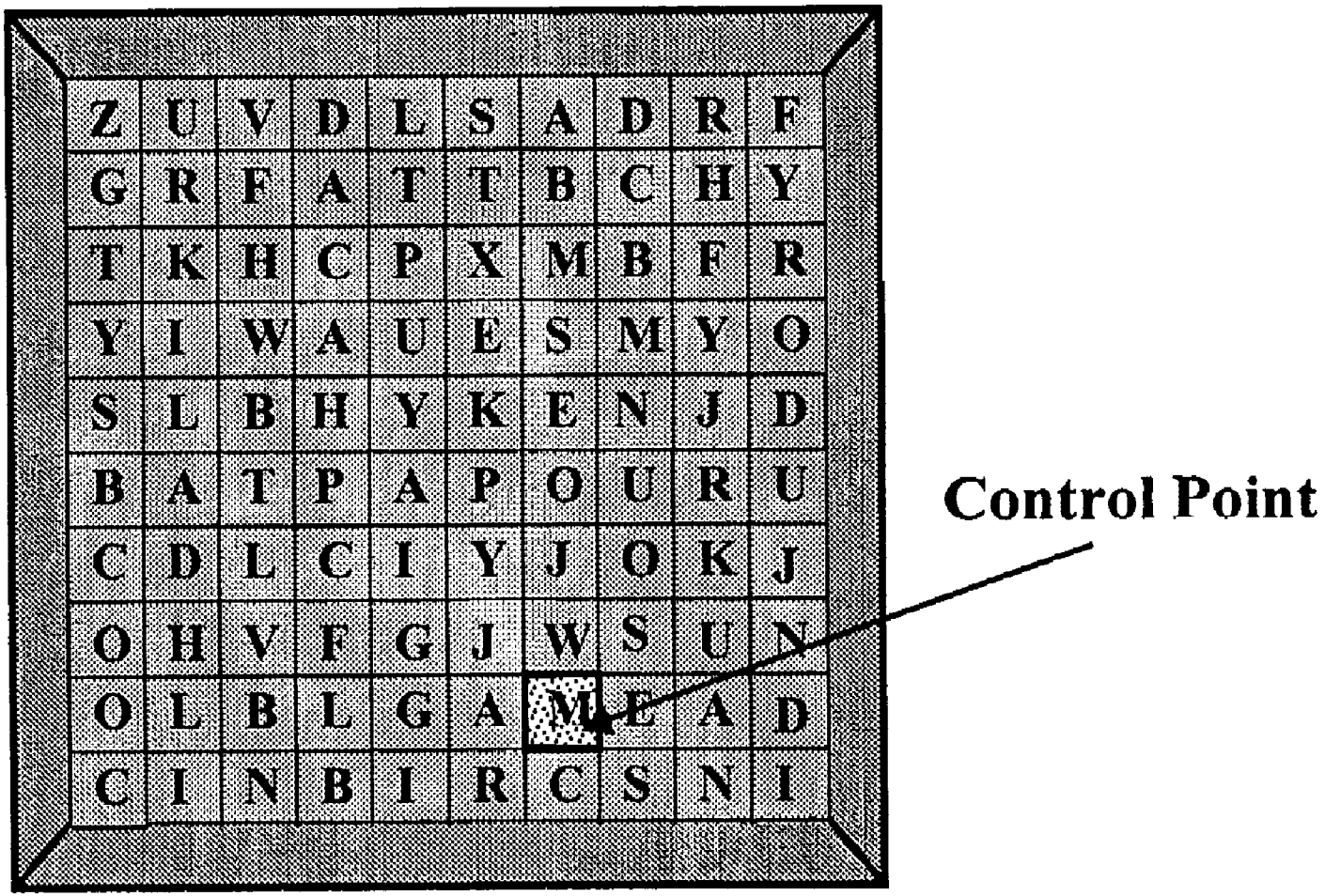
Figure 38:
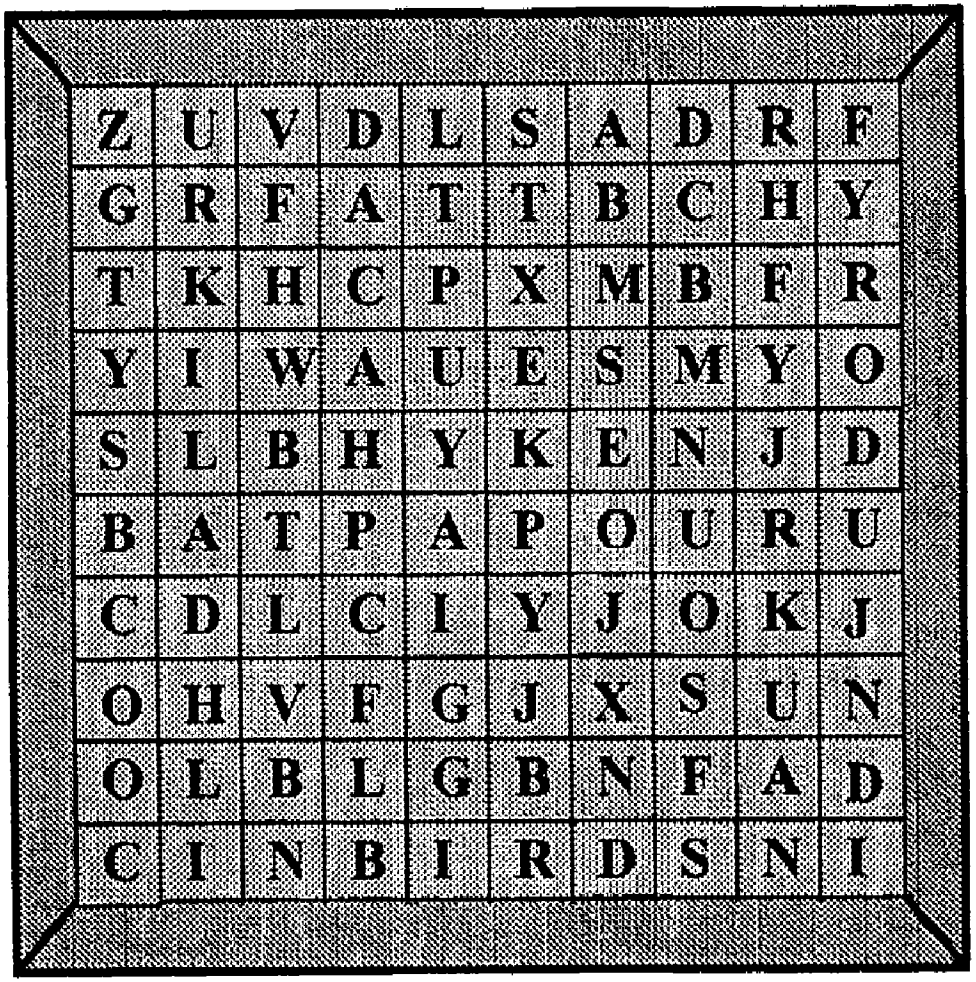

The number and locations of control points are design parameters that may vary based on the desired embodiment. Similarly, the specific geometric pattern associated with a control point is a design choice. For the preferred embodiment, a control point is provided at each playing position as shown in FIG. 33, and the fixed geometric relationship shown in FIG. 25 is provided at each control point. It should be noted that it is not necessary to provide a control point at each playing position, different embodiments may be constructed utilizing control points located at every other playing position for example. Further, each control point may utilize a different cause/effect relationship. Examples of various control point configurations are indicated in FIGS. 31 & 32. Similar to the shift operation, a cause/effect operation incorporates a "wrap around" function. Said function is based on a geometric relationship pattern between control points and play positions located at the boundary of the play field. For a two-dimensional rectangular play field, the boundary of the play field is defined as the top and bottom rows, and the left and right columns. For a circular two-dimensional playfield, the boundary is defined as the play positions located at the circumference of the circle. For a three-dimensional play field such as a cube, the boundary is defined as the play positions located at the twelve (12) edges of the cube. A playfield mapped on the surface of a sphere has no boundary. Examples of wrap around geometric relationship patterns for a two-dimensional rectangular play field, using the fixed geometric relationship of FIG. 25, are provided in FIGS. 29 & 30.

Upon the activation of a control point, the characters at the affected display locations are replaced with other characters based on predefined sequence. Each display location has a plurality of logical states, each of which defines a replacement character for an initial character of the alphabet. Further each of these logical states is reached by successive activations of an associated control point, or by a sequence of activations of various control points affecting the display position. The number of logical states per display location is a design choice. For example, in a game that provides two logical states per display location, and where the replacement of characters is based on a simple rule of substituting a letter with a consecutive letter from the alphabet set as indicated in FIG. 3, and if the initial letter is "J," then upon the activation of a first control point associated with the display position, the letter "J" is be replaced by the letter "K." A second activation of said first control point, or an activation of another control point associated with the display location, would replace the letter "K" with the initial letter "J." Similarly, in a game that provides three logical states per display position, and using the replacement rule indicated in FIG. 4, and if the initial letter is "C," then upon the first activation of a first associated control point, the letter "C" is replaced with the letter "D." Upon the second activation of said first control point, or the first activation of a second control point associated with the display position, the letter "D" is replaced with the letter "E." Then upon the third activation of the first control point, the second activation of the second control point, or the first activation of a third control point associated with the display location, the letter "E" is replaced with the initial letter "C." The replacement rules for a third example that employs four logical states per display position is indicated in FIG. 5.

A step-by-step example to form an initial game display from an initial configuration of letters, using the cause/effect process, and the letter substitution that employs two logical states for each display position as indicated in FIG. 3, is indicated in FIGS. 34-38. In said example, the control points at playing positions 22-(4, 3), 22-(5, 8), 22-(8, 7) & 22-(7, 2) are activated to form the initial game display shown in FIG. 38.

Therefore, in the preferred embodiment, the "find a word" game is further defined by two additional parameters that consist of a description of the scrambling steps used to generate the initial display from the initial configuration of characters. Accordingly, the second game parameter consists of the specific shift operations utilized to scramble the initial configuration. A shift operation is defined by a set of attributes that consist of the identification of the row or column, the shift direction, and the number of shift positions in the specified direction. Similarly, the third game parameter consists of the specific control points activated to scramble the initial configuration. All three game parameters are stored in a data section of the control program, or in an external memory that provides additional games.

Three difficulty levels of play are provided by the preferred embodiment. At the beginner level, games are presented to a player using the scramble process defined by the original game parameters. If a player selects an intermediate level of play, then additional scramble parameters are introduced to further hide the predetermined words from the player. Similarly, at the advanced level, more scrambled parameters are introduced into the game. The additional scramble parameters are also stored in a data section of the control program, or in the external memory.

It should be noted that the aforestated disclosure of three levels of difficulty is being provided solely for describing the preferred embodiment, and is not intended to limit the present invention. As would be understood by a person of ordinary skills in the art, other structures for varying the difficulty level of play may be provided in alternate embodiments. For example, games may be classified and grouped based on difficulty levels. At a beginner level, a player would select a game from a category of "easy" games. At the intermediate level, the selection is made between games of moderate difficulty, and at the advanced level selection is made between difficult games. Another method to increase the difficulty level of play is by the formation of words similar to hidden words at a transition board between the initial display board, and the final solution board that contains all the hidden words. A word is similar to a hidden word if it contains two or more letters from the hidden word in the same relative positions. The formation of such similar words during game play would make the game more challenging since a player may have to explore such similar words before solving the puzzle.

A third method to increase the level of difficulty of play is based on increasing the number of logical states per display locations. For example, a beginner level would employ two logical states per display location, an intermediate level would employ three logical states, and an advanced level would employ four logical states. As would be obvious to a person with ordinary skills in the art, a game designer may employ any combination of these methods to vary the level of difficulty in a particular game. For the preferred embodiment, the level of difficulty is increased or decreased by varying the number of scrambling steps applied to the initial configuration.

Upon finding a hidden word, a player may capture such word by performing the "highlight" and "select" functions. To highlight a word, the player positions the curser at the beginning character of the word, and activates the select button. The player then positions the curser at the last character of the word, and activates the select button for a second time. The word is then highlighted by a different shade at the play locations where the word is located. To capture and receive a credit for a word, the player must activate the select button for a third time. Upon the selection of a word, the shading for the associated playing positions is changed, and all scrambling functions, affecting that word, are disabled. For example, if the captured word is located on a vertical axis, and if the shift scrambling process is used, then the shift functions for rows corresponding to the word characters are disabled. However, the column where the word is located is free to move up or down.

Referring now to the flow diagrams shown in FIGS. 7 through 20, and following the selection of game type, scramble process and difficulty level, the player is requested to select a "next" game. The player is given three options. He or she may elect to repeat the game currently in play, select a specific game from a plurality of stored games, or select a new game at random using the random option. The microprocessor would then load the selected game data, including parameters associated with the selected difficulty level, into the Random Access Memory (RAM). Upon the activation of the "START" button by the player, the microprocessor starts running a timer function, and executes the segment of the control program that scrambles the initial configuration of characters in order to generate an initial board presented to the player. The microprocessor then displays said initial board on the LCD screen.

If the selected game type is "Find a Word," then the microprocessor will provide the player with a list of the hidden words that must be uncovered. The microprocessor then awaits an input from the player. Such an input may consist of a shift process, the activation of a control point, or the steps to highlight a plurality of characters. If the player's input consists of either a shift process or an activation of a control point, then the control program will validate if the game in play includes such attributes. If the player's action is valid, then the microprocessor, under the direction of the control program, will execute such shift process or control point activation. Alternatively, if the player's action is not valid, then the microprocessor will generate a sound effect indicating to the player that he or she must initiate a new action.

If the player's input consists of the highlighting of a plurality of characters, then the player is required to follow up with a second action to either select or release the highlighted characters. If the highlighted characters are selected, then the microprocessor will determine if said characters represent a valid hidden word. If valid, the microprocessor will generate a sound effect indicating success to the player, and will adjust the score based on predetermined rules. The microprocessor will also disable any scramble function that affect the word uncovered by the player. For example if the shift process is used, and if the uncovered word is located on a horizontal axis, then the shift function for all vertical columns corresponding to the characters in the uncovered word will be disabled. Similarly, if control points are used to scramble the display, then all control points affecting the uncovered word will be disabled. The control program will then cause a list of remaining hidden words to be displayed on the LCD screen, and will await an input from the player. If the player is successful in finding all of the hidden words, then the microprocessor, under the direction of the control program, will generate "end of game" sound effects, will display the final score on the LCD screen, and will return control to the start segment of the control program. Alternatively, if the selected word is not a valid hidden word, then the microprocessor, under the direction of the control program, will generate a sound effect indicating that the selected word is not valid. The microprocessor will then remove the shading from the highlighted and selected word, will flash on the LCD screen a list of remaining hidden words, and will await an input from the player.

If the highlighted characters are released, then the microprocessor will generate a sound effect acknowledging such release. The microprocessor will then adjust the score by subtracting points associated with the released word from the player's score. The microprocessor will also enable the shift and control point functions affecting the released word. If the game incorporates a time limitation, then the control program will continuously monitor the lapsed time since the start of the game to ensure that the player does not exceed the allotted time for the game.

Alternatively, if the selected game is "Form a Word," then similar to "Find a Word" game, the player may perform a shift process, activate a control point, or initiate the steps to highlight a plurality of characters. If the player's input consists of either a shift process or an activation of a control point, then the control program will validate if the game in play includes such attributes. If the player's action is valid, then the microprocessor, under the direction of the control program, will execute such shift process or control point activation. Alternatively, if the player's action is not valid, then the microprocessor will generate a sound effect indicating to the player that he or she must initiate a new action.

If the player's input consists of the highlighting of a plurality of characters, then the microprocessor will determine if said characters represent a valid word. Such a validation is performed through the use of a thesaurus or dictionary subroutine using data stored in ROM or in an external memory. If the highlighted word is valid, then the microprocessor will generate a sound effect indicating success to the player, will adjust the score based on predetermined rules, and will await an input from the player. Conversely if the highlighted word is not found in the dictionary of valid words, then the microprocessor will generate a sound effect indicating to the player that the word is not valid. The microprocessor will then remove the shading from the highlighted word, and will await an input from the player. The player may continue to form as many words as possible until the time allotted for the game expires. When such time is up, the microprocessor, under the direction of the control program, will display the final game score, and will generate "end of game" sound effects. The microprocessor will then return control to the start segment of the control program to start a new game if requested by the player.

As will be understood by those skilled in the art, additional alternate embodiments may come in different shapes and colors. Further, many different embodiments may be based on the concepts disclosed in the logic flow diagrams of FIGS. 7 to 20. These logical flow diagrams are only one example of how to implement the new general concept of an electronic word game that incorporates logical steps to make a game more interesting and challenging. Furthermore, many programs may be utilized to implement said flow diagrams disclosed in FIG. 7 through FIG. 20. Obviously these programs will vary from one another in some degree. However, it is well within the skill of the computer programmer to provide particular programs for implementing each of the steps of the flow diagrams disclosed herein. Further, the concept of using logical steps to make a word game more challenging can be expanded to other word games. For example, a crossword puzzle can utilize the logical structure of shifting rows and/or columns in order to scramble common letters between intersected words. It is also to be understood that the foregoing detailed description has been given for clearness of understanding only, and is intended to be exemplary of the invention while not limiting the invention to the exact embodiment shown. Obviously certain subsets, modifications, simplifications, variations and improvements will occur to those skilled in the art upon reading the foregoing. For example, a shift process may be implemented along a diagonal axis. Also, based on the teachings of this invention, it would be obvious for a person of ordinary skills to develop a circular playing field using rotation as a logical shift structure. It is, therefore, to be understood that all such modifications, simplifications, variations and improvements have been deleted herein for the sake of conciseness and readability, but are properly within the scope and spirit of the following claims.

What is claimed and desired to be secured by letters of patent is:

1. A word game device having an objective to find or form words, comprising:

a playfield that includes a plurality of playing positions, wherein a playing position is used to display a character of an alphabet, wherein an initial set of alphabet characters are assigned to playing positions to form at least one game word, and wherein at least one game word is scrambled by having at least one character shifted into a position that does not lie along the same axis common to the other characters in the word, a microprocessor with a computer-readable medium encoded with a computer program to control the operation of the game device, an input control mechanism to enable a player to interact with the device, means for replacing alphabet characters assigned to playing positions, and means for determining if a game objective has been achieved.

2. A word game device as recited in claim 1 further comprising a housing.

3. A word game device as recited in claim 2 wherein said plurality of playing positions is mapped on the surface of a three-dimensional housing.

4. A word game device as recited in claim 3, wherein said three-dimensional housing is in the form of a cube.

5. A word device as recited in claim 4, wherein said means for replacing alphabet characters assigned to playing positions is based on shifting an entire perimeter strip of characters around the corresponding axis of the cube.

6. A word device as recited in claim 3, wherein said three-dimensional housing is in the form of a sphere.

7. A word device as recited in claim 6, wherein said means for replacing alphabet characters assigned to playing positions is based on shifting an entire circular arc of characters around the corresponding axis of the sphere.

8. A word game device as recited in claim 1 further comprising at least one of a structure that produces visual effects, and a structure that produces sound effects.

9. A word game device as recited in claim 1 wherein said means for replacing alphabet characters assigned to playing positions includes at least one of shifting an entire row of characters, and shifting an entire column of characters.

10. A word game device as recited in claim 1, wherein said plurality of playing positions form a two-dimensional array.

11. A word game device having an objective to form or find words, comprising:

a playfield that includes a plurality of playing positions, wherein a playing position is used to display a character of an alphabet, wherein an initial set of alphabet characters are assigned to playing positions to form at least one game word, and wherein at least one game word is scrambled by having at least one character shifted into a position that does not lie along the same axis common to the other characters in the word, a microprocessor with a computer-readable medium encoded with a computer program to control the operation of the device, a plurality of switches to enable a player to interact with the device, a computer program segment that is responsive to the activation of a switch, and which implements means for replacing alphabet characters assigned to playing positions, and a computer program segment to determine if a game objective has been achieved.

12. A word game device as recited in claim 11 further comprising a housing for the device.

13. A word game device as recited in claim 12 wherein said plurality of playing positions is mapped on the surface of a three-dimensional housing.

14. A word game device as recited in claim 13, wherein said three-dimensional housing is in the form of a cube.

15. A word device as recited in claim 14, wherein said means for replacing alphabet characters assigned to playing positions is based on shifting an entire perimeter strip of characters around the corresponding axis of the cube.

16. A word device as recited in claim 13, wherein said three-dimensional housing is in the form of a sphere.

17. A word device as recited in claim 16, wherein said means for replacing alphabet characters assigned to playing positions is based on shifting an entire circular arc of characters around the corresponding axis of the sphere.

18. A word game device as recited in claim 11 further comprising at least one of a structure that produces visual effects, and a structure that produces sound effects.

19. A word game device as recited in claim 11, wherein said means for replacing alphabet characters assigned to playing positions is based on an algorithm that shifts at least one of the characters assigned to an entire row of playing positions, and the characters assigned to an entire column of playing positions.

20. A word game device as recited in claim 11, wherein said plurality of playing positions form a two-dimensional array.

21. A word game device having at least one of a game objective to find at least one word hidden on the playfield, and a game objective to form at least one word on the playfield, and comprising:

a housing for the device, a playfield that includes a plurality of playing positions, wherein a playing position is used to display a character of an alphabet, wherein an initial set of alphabet characters are assigned to playing positions to form at least one game word, and wherein at least one game word is scrambled by having at least one character shifted into a position that does not lie along the same axis common to the other characters in the word, a microprocessor with a computer-readable medium encoded with a computer program to control the operation of the device, at least one of a plurality of switches, curser control mechanism, and touch screen control mechanism to enable a player to interact with the device, a computer program segment responsive to an input control mechanism that implements means for replacing alphabet characters assigned to playing positions, and a computer program segment to determine if a game objective has been achieved.

22. A word game device with a game objective to find or form words, comprising:

a housing for the device, a playfield that includes a plurality of playing positions, wherein a playing position is used to display a character of an alphabet, and wherein an initial set of alphabet characters are assigned to playing positions to form at least one game word, and wherein at least one game word is scrambled by having at least one character shifted into a position that does not lie along the same axis common to the other characters in the word, a plurality of input control mechanisms to enable a player to interact with the device, a microprocessor with a computer-readable medium encoded with a computer program to control the operation of the device, a program segment that is responsive to input control mechanisms, and which modifies the alphabetic display by employing an algorithm that shifts at least one of an entire row of characters and an entire column of characters.

23. A method for providing an electronic word puzzle in a device with a game objective to find or form words, wherein the device has a playfield that includes a plurality of playing positions, and wherein a playing position is used to display a character of an alphabet, comprising the steps of:

providing an initial display of alphabet characters that are assigned to playing positions, such that at least one word is scrambled by having at least one character shifted into a position that does not lie along the same axis common to the other characters in the word, providing at least one game tool that provides a player with means for replacing characters at playing positions, and determining if the player was successful in achieving a game objective.

24. The method recited in claim 23, wherein said means for replacing characters is based on at least one of an algorithm that shifts an entire row of characters and an algorithm that shifts an entire column of characters.

25. A word game device with a game objective to find or form words, comprising:

a playfield that includes a plurality of playing positions, wherein a playing position is used to display a character of an alphabet, and wherein an initial set of alphabet characters are assigned to playing positions to form at least one game word, and wherein at least one game word is scrambled by having at least one character shifted into a position that does not lie along the same axis common to the other characters in the word, at least one input control mechanism to enable a player to interact with the device, a microprocessor with a computer-readable medium encoded with a computer program to control the operation of the device, and a program segment that is responsive to input control mechanism, and which shifts characters along a selected axis on the playfield.

26. A word game device as recited in claim 25 further comprising a housing.

27. A word game device as recited in claim 26 wherein said plurality of playing positions is mapped on the surface of a three-dimensional housing.

28. A word game device as recited in claim 27, wherein said three-dimensional housing is in the form of a cube.

29. A word device as recited in claim 27, wherein said three-dimensional housing is in the form of a sphere.

30. A word game device as recited in claim 25, wherein said plurality of playing positions form a two-dimensional array.

* * * * *